United States Patent [19]

Jantzen

[11] Patent Number: 5,060,426

[45] Date of Patent: Oct. 29, 1991

[54] BUILDING STRUCTURE

[75] Inventor: Michael E. Jantzen, Clinton County, Ill.

[73] Assignee: Hypertat Corporation, St. Louis, Mo.

[21] Appl. No.: 853,778

[22] Filed: Apr. 18, 1986

[51] Int. Cl.[5] ..... E04B 1/32

[52] U.S. Cl. ..... 52/86; 52/89; 52/126.1; 52/584

[58] Field of Search ..... 52/86, 89, 263, 584, 52/126.6

[56] References Cited

U.S. PATENT DOCUMENTS

| | | | |
|---|---|---|---|
| D. 89,643 | 4/1933 | Kreutzer . | |
| D. 89,644 | 4/1933 | Kreutzer . | |
| D. 89,645 | 4/1933 | Kreutzer . | |
| D. 89,967 | 5/1933 | Kreutzer . | |
| D. 130,582 | 12/1941 | Kaufmann . | |
| D. 138,436 | 8/1944 | Clark . | |
| D. 138,447 | 8/1944 | Van Scoy et al. . | |
| D. 139,082 | 10/1944 | Larkin . | |
| D. 160,325 | 10/1950 | Lang . | |
| D. 225,103 | 11/1972 | Hardman . | |
| D. 232,543 | 8/1974 | Kelbish . | |
| 1,350,493 | 8/1920 | Goodrich . | |
| 1,955,464 | 4/1934 | Lenneville | 52/534 |
| 1,981,417 | 11/1934 | Kreutzer . | |
| 1,981,419 | 11/1934 | Kreutzer . | |
| 2,087,931 | 7/1937 | Wallace | 52/387 |
| 2,095,653 | 10/1937 | Tepel | 403/353 |
| 2,268,636 | 1/1942 | Becker | 52/580 |
| 2,321,916 | 6/1943 | Ingerman | 403/353 |
| 2,378,275 | 6/1945 | Williamson . | |
| 2,475,433 | 7/1949 | McLaughlin | 52/86 |
| 2,918,992 | 12/1959 | Gelsarage | 52/81 |
| 2,963,825 | 12/1960 | Douglas, Jr. | 52/584 X |
| 2,970,677 | 2/1961 | Springs, Jr. et al. | 52/584 X |
| 3,031,043 | 4/1962 | Dresser et al. | 52/584 X |
| 3,043,054 | 7/1962 | Schmidt . | |
| 3,082,489 | 3/1963 | Douglas . | |
| 3,141,206 | 7/1964 | Stephens . | |
| 3,282,613 | 11/1966 | Axelsonn | 52/584 X |
| 3,364,633 | 1/1968 | Polo . | |
| 3,470,663 | 10/1969 | Tate | 52/263 X |
| 3,535,834 | 10/1970 | Nichols . | |
| 3,597,890 | 8/1971 | Hala . | |
| 3,750,353 | 8/1973 | Smith, Jr. . | |

(List continued on next page.)

FOREIGN PATENT DOCUMENTS

| | | | |
|---|---|---|---|
| 292650 | 9/1967 | Australia | 52/81 |
| 0091534 | 7/1961 | European Pat. Off. . | |
| 1549539 | 11/1968 | France | 52/86 |
| 1569562 | 6/1969 | France | 52/551 |
| 401665 | 1/1943 | Italy | 52/86 |
| 557937 | 1/1975 | Switzerland | 52/584 |
| 643355 | 9/1950 | United Kingdom | 52/86 |
| 1049861 | 11/1966 | United Kingdom | 52/86 |

OTHER PUBLICATIONS

"Pictures"—St. Louis Post-Dispatch—A Home for All Seasons, Kristen Peterson, Sunday, Sep. 10, 1978, pp. 30-33.

Panelarch, "Off-the-Shelf" Building Systems brochure, National Shield Weld, Ltd.

"Domus—Monthly Review of Architecture Interiors Design Art", Dec. 1986, pp. 8-10.

"Building"—Visionary House at One with Nature, Fall 1978, pp. 102-105.

*Primary Examiner*—Henry E. Raduazo

*Attorney, Agent, or Firm*—Polster, Polster and Lucchesi

[57] ABSTRACT

An easily transported and erected building structure formed in part as a vault made of interlocking voussoirs in the form of identical insulated boxes. Permanent exterior joint connectors prestress the voussoirs for strength. Easily installed interior clips join the voussiers. A floor made of insulated boxes is supported on a quickly-assembled adjustable structural frame. End walls made of insulating boxes close the ends of the vault or vaults. External cladding and interior finishing panels, corresponding generally to the dimensions of the voussoirs, are easily installed and removed. Interior raceways are formed along the joinder lines of the insulated boxes. All of the parts of the structure are designed for erection of the structure in harsh environments, without handling small loose parts.

47 Claims, 12 Drawing Sheets

U.S. PATENT DOCUMENTS

| | | | |
|---|---|---|---|
| 3,802,133 | 4/1974 | Gregory . | |
| 3,815,307 | 6/1974 | Tantlinger | 52/588 |
| 3,832,812 | 9/1974 | Hiatt . | |
| 3,838,545 | 10/1974 | Kump . | |
| 3,849,012 | 11/1974 | Krouse | 403/353 |
| 3,894,369 | 7/1975 | Schmitt et al. . | |
| 3,968,604 | 7/1976 | Hills . | |
| 3,984,950 | 11/1976 | Hildebrand | 52/86 |
| 4,023,317 | 5/1977 | Bettger et al. . | |
| 4,074,487 | 2/1978 | Daniels et al. | 52/263 X |
| 4,106,256 | 8/1978 | Cody | 52/694 X |
| 4,120,123 | 10/1978 | Knudson . | |
| 4,235,559 | 11/1980 | Rooklyn | 403/171 |
| 4,262,464 | 4/1981 | Ludowici . | |
| 4,326,365 | 4/1982 | Svensson . | |
| 4,633,626 | 1/1987 | Freeman | 52/126.6 |

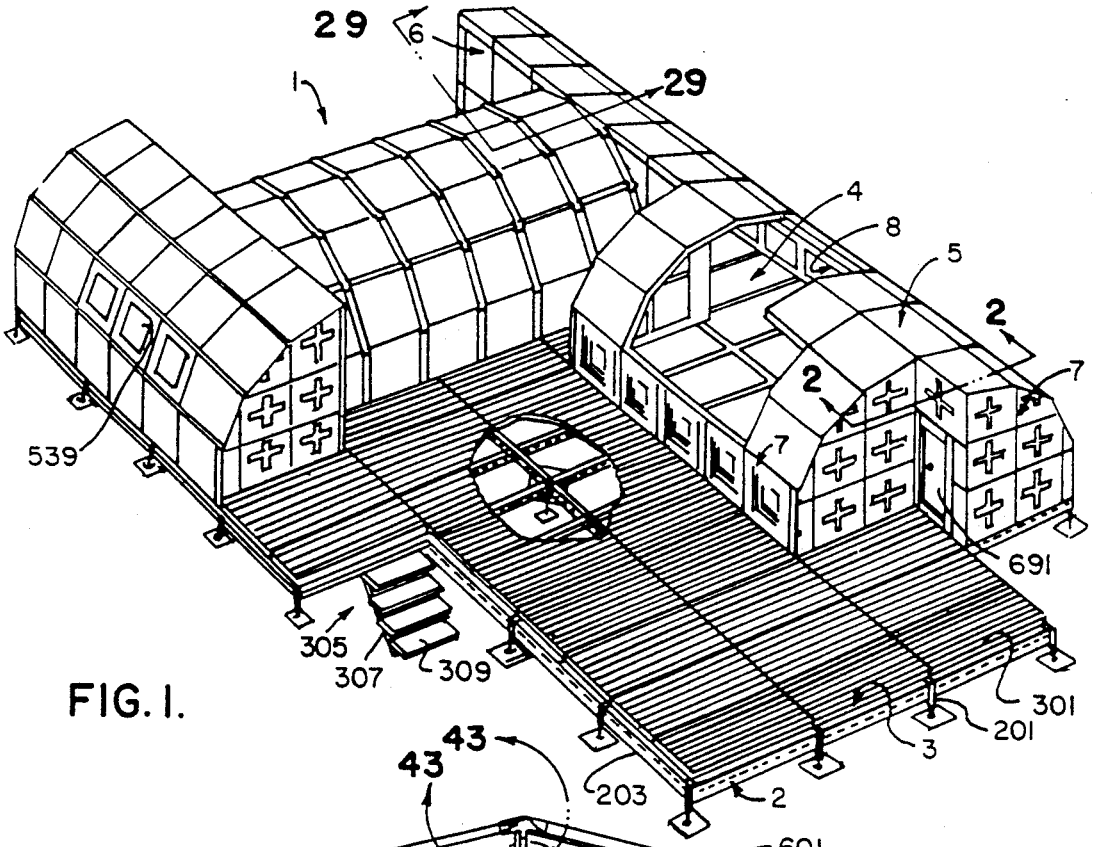
FIG. 1.
FIG. 2.
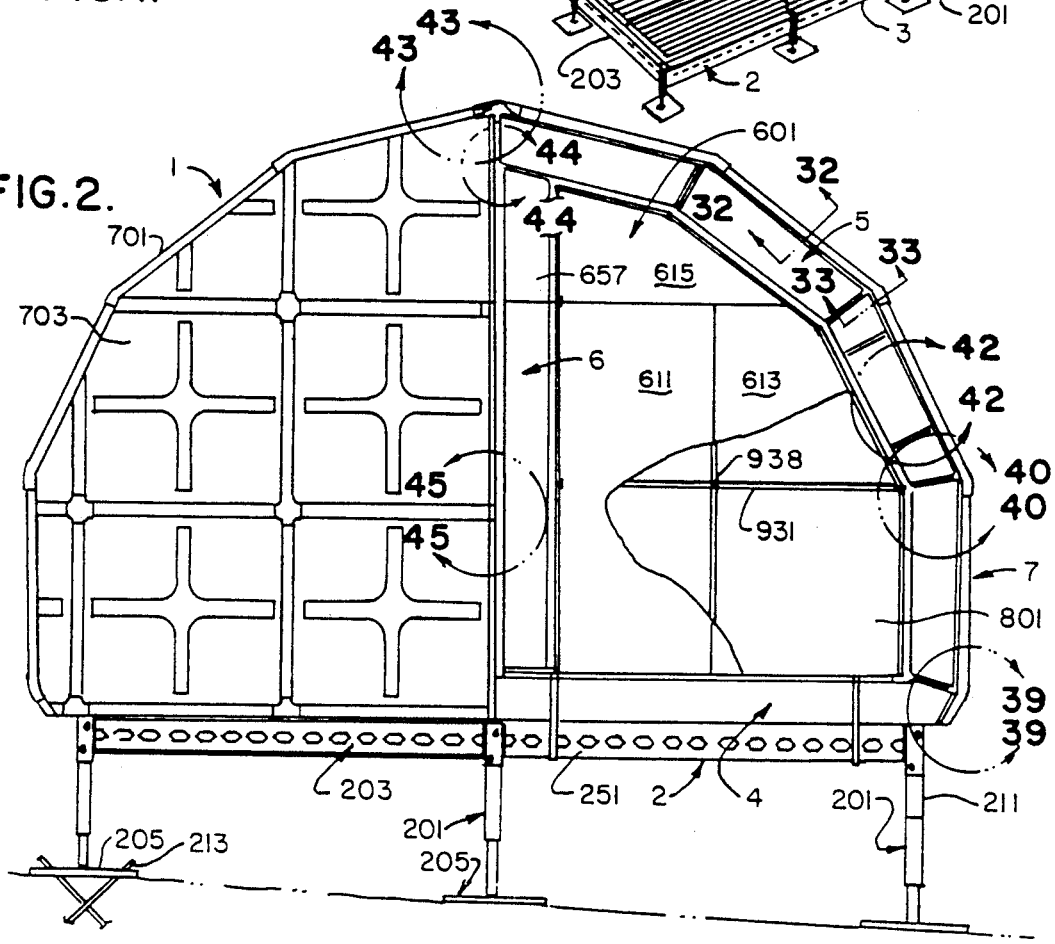

BUILDING STRUCTURE

BACKGROUND OF THE INVENTION

This invention relates to a building structure, and in particular to a transportable modular building structure.

Prefabricated transportable building structures have long been recognized as desirable. Many transportable building structures have heretofore been proposed. Such structures may provide conventional housing, in the manner of mobile homes, or they may provide conventional office, manufacturing or storage, in the manner of prefabricated metal buildings, or they may provide easily transportable and erectable temporary shelter, in the manner of tents or the type of structure shown in Hills, U.S. Pat. No. 3,968,604.

All of these types of structures suffer from major drawbacks.

Many prior art structures are made in such large modules that they can not be transported in standard eight foot by eight foot by twenty foot shipping containers or transported on a standard flatbed or trailer truck. They are therefore difficult to transport, particularly to remote locations.

The modules frequently require several persons or heavy equipment for unpacking and assembly of the structure. The structures sometimes require extensive site preparation. They require small parts which may be difficult to handle and tend to become lost. All of these problems are greatly magnified when the structure is to be assembled in a harsh or remote environment.

Most of the structures are not well adapted for long-term use. They tend to be of simple geometry, and can be assembled in only one internal and external configuration. This configuration is frequently not ideal even for the use for which the structure is designed. Likewise, the interior and exterior appearance of these structures is predetermined. They are therefore also limited in their uses. They also tend to lack great structural strength and are therefore of limited use in many environments which subject them to wind or snow loading.

The structures are difficult to isolate from their environment. They tend to leak water into the interior and to leak heat and air into or from the interior. They are frequently not well insulated or require difficult application of insulation in the field. It is thus difficult to make them habitable without the use of large sources of outside energy. They are also difficult to isolate from electromagnetic radiation of various wavelengths.

SUMMARY OF THE INVENTION

One of the objects of this invention is to provide a transportable, modular building structure which is easy to transport and assemble even in remote and hostile environments.

Another object is to provide such a structure which is exceptionally strong and which may be superinsulated at the factory.

Another object is to provide such a structure which may be modified easily to provide windows, doors, and accessories as required.

Another object is to provide such a structure which may be repeatedly assembled and disassembled in different architecturally interesting configurations.

Another object is to provide such a structure which may be fitted with various outside coverings and various inside configurations to suit a multitude of inhabited and uninhabited uses.

Other objects of this invention will be apparent to those skilled in the art in light of the following description and accompanying drawings.

In accordance with one aspect of this invention, generally stated, a modular building structure is provided comprising a plurality of modules in the form of voussoirs stacked to form at least a part of a barrel vault, each of the voussoirs comprising a hollow box, the box comprising a rectangular outer wall, a rectangular inner wall, the inner wall being smaller in at least one dimension than the outer wall, a pair of trapezoidal side walls, and rectangular top and bottom walls.

Preferably, the voussoirs have substantially the same dimensions and form the sides of a regular fourteen sided figure or tetradecagon. Each of the outer walls has a height of from three to five feet, eight of the voussoirs being stacked to form an arch section of a full barrel vault, the lowermost voussoirs being vertical. This configuration provides a remarkable amount of head room, even close to the edges of the structure, as compared with semicircular barrel vaults, whose limited head room at their margins makes them both practically and psychologically smaller than their maximum dimensions.

Each of the voussoirs includes interconnecting hook means on at least two parallel sides of the outer wall for connecting the voussoir to other voussoirs, the interconnecting means causing the outer wall to be tensioned when the voussoirs are stacked. This prestressing of the outer wall greatly increases the resistance of the structure to external loading, as by wind or snow.

The strength of the structure is obtained from the modules themselves, rather than from a separate frame structure to which the modules are attached.

In accordance with another aspect of the invention, the modules comprising the building structure include inwardly extending lip means, positioned around the periphery of their inner wall, for connecting the module to other modules, the modules being placed edge to edge so that the broad inner walls define an interior surface of the structure, and connector means accessible only from within the structure for connecting the lip means of adjacent modules to each other to provide a secure structure. The lips form a lattice which supports utility lines extending across the modules. Wiring and plumbing may therefore be greatly simplified, since continuous paths are provided between intersections of any two modules.

Preferably, the connector means are novel U-shaped clips which include pins extending through aligned apertures in the lips of adjacent modules. The clips are rotatable around the pins to compress the lips. Insulation between adjacent vertical edges is compressed when the lips of adjacent modules are connected.

Because the voussoirs are hollow boxes, they may be filled with any desired amount of insulation of any desired type. Full insulation of a ten-inch deep box with fiberglass insulation may give an insulation value of R-35, and a full phenolic foam fill may give a value of up to R-80.

Vertical modules of similar construction to the voussoirs preferably close the ends of the vault. The vertical modules include peripheral lip parts; the same clip connectors hold the vertical modules to each other and other clip connectors hold the vertical modules to the voussoirs. The vertical modules may be insulated to approximately the same values as the voussoir or arch modules.

Finishing panels are preferably attached to the lip means on the inner walls of the modules. The finishing panels preferably have dimesions substantially equal to the dimensions of the inner walls of the voussoir modules and are parallel with and spaced from the inner walls of the modules. This arrangement permits the finishing panels to carry furniture, lighting, utilities, and the like, which may be shipped, installed, and relocated with the finishing panel as a single assembly.

Cladding shingles are preferably attached to the exterior of the modules, the cladding shingles having dimensions slightly greater than the dimensions of the outer faces and being spaced from the outer faces of the modules, the cladding shingles overlapping each other to define a substantially continuous outer skin over at least a top and two sides of the structure. The shingles may include window openings, utility penetrations, and the like, and they may be formed of different materials to suit particular uses of the structure. The shingles are moveable with respect to each other to permit expansion and contraction of the shingles with changes in temperature, and the shingles include rain gutter means along a vertical edge thereof and cap means on an opposite vertical edge thereof, the cap means of one shingle overlapping the rain gutter means of an adjacent shingle.

Windows in the arch modules of the structure include an opening in their outer and inner walls and a window structure mounted between the openings, the window structure including peripheral wall means extending between the openings. Utility penetrations, including air-to-air heat exchangers as well as conventional utilities and waste lines, may utilize a similar construction. Doors in the vertical modules are of similar construction.

The building structure preferably includes a base frame support, including a plurality of adjustable ground-engaging uprights, and a modular floor consisting essentially of a plurality of insulatable hollow modules arranged side-to-side to form a continuous floor, the floor modules being supported by the frame. The floor modules preferably include peripheral lip means which are held to each other by clips of the same type which hold the arch modules to each other. The floor includes downwardly outward sloping surfaces which engage bottom walls of the bottom row of voussoirs, so that the bottom row of voussoirs are vertical. The floor thus becomes effectively another row of voissoirs and utilizes locking means which are identical with the locking means between the arch modules. A floor pallet is mounted on each floor module, the pallet being smaller in at least one dimension that the floor module, and the floor pallets define a floor surface and raceways in the floor surface between the pallets. The floor modules and pallets may also be filled with insulation, to give the same type of insulation values as the arch modules.

The frame support includes a plurality of adjustable ground-engaging uprights, each upright including adjustment means for adjusting the height of the upright and a fitting piece attached to an upper end of the upright, the fitting piece including at least two fittings, and a plurality of horizontal joists supported above ground by the uprights, each joist including flange means at its ends for releasably connecting the joist to one of the fittings. The joists are arranged as a rectangle having uprights at least at the corners thereof, the rectangle including side joists defining a pair of sides, and a plurality of parallel cross joists attached to the side joists intermediate the uprights, the side joists being C-shaped in cross section, and the cross joists including end flanges, the structure further including attachment plates interfitted into the C-shaped side joists, the end flanges of the cross joists and the attachment plates being releasably connected. Each of the uprights includes a vertical column, height adjusting means in the column, a foot pad, means for anchoring the foot pad to the earth, and pivot means for attaching the foot pad to the column. An extension piece removably connected to an upper end of at least one column permits extending the height of the upright. The flange means on the joist includes a slot and the fitting includes a headed bolt for interengagement with the slot, the bolt being tightenable after engagement with the slot. Each joist includes a pair of C-beams attached back-to-back, and an opening between the C-beams, and the structure further includes anchoring means extending into the slot for anchoring the modular building to the joists.

In accordance with another aspect of the invention, the building structure includes at least one portion formed from arch elements forming a full barrel vault having an axial length, a height, and a width, and at least a second portion formed from arch elements and vertical wall elements forming a half barrel vault having an axial length substantially greater than the width of the full barrel vault and a height equal to the height of the full barrel vault. The half barrel vault may be perpendicular to the full barrel vault, an end of the full barrel vault mating with the vertical wall elements of the half barrel vault to form a continuous T-shaped interior of the building structure. The structure may also be configured with the half barrel vault forming an axial continuation of the full barrel vault. The vertical wall of the half barrel vault may be formed in part of modules identical with end-wall modules, and in part of modules of the same general construction as the end-wall and arch modules.

The method of erecting the modular building comprises a step of mounting a first module in generally vertical position, thereafter a step of mounting a second module by tilting the second module outwardly to interengage hook means and sill means on the outside of the first and second modules, thereafter a step of rotating the second module to a desired position, and thereafter a step of locking a locking means on the inside of the first and second modules. The locking means comprise the inwardly extending lip means on inside edges of the modules, and the clips.

Other aspects of the invention will best be understood in light of the following description of the preferred embodiments of the invention.

BRIEF DESCRIPTION OF THE DRAWINGS

In the drawings,

FIG. 1 is a view in perspective, partially broken away, of one illustrative embodiment of the building structure of the present invention.

FIG. 2 is a somewhat diagramatic sectional view, taken along the line 2—2 of FIG. 1, showing both a half arch and a full arch section of the structure of FIG. 1.

DESCRIPTION OF THE PREFERRED EMBODIMENT

Figure 3:
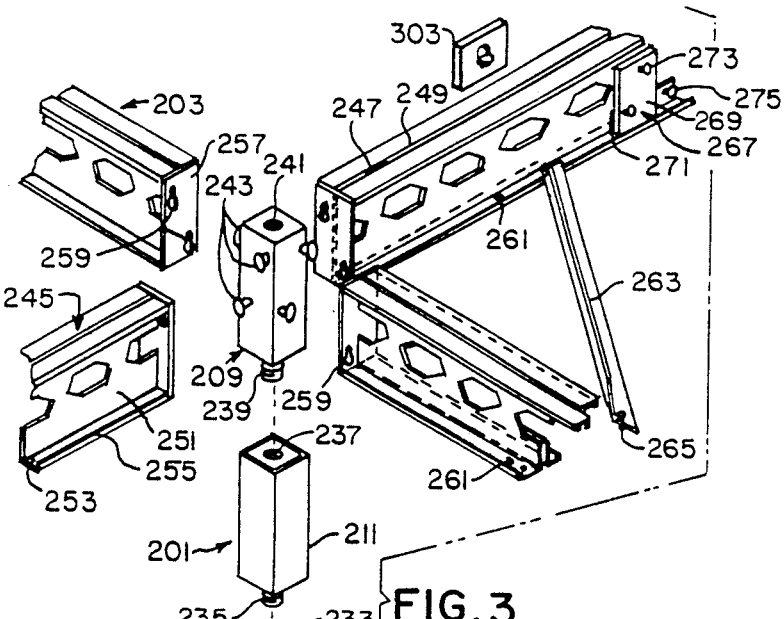
FIG. 3 is an exploded view of a support frame portion of the structure of FIGS. 1 and 2.
Figure 4:
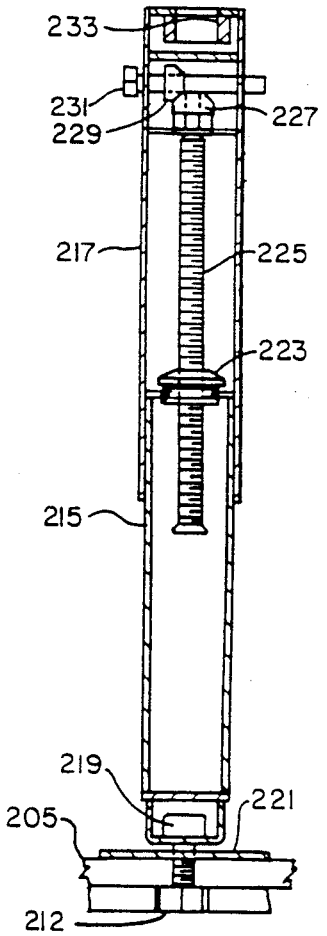
FIG. 4 is a sectional view of an upright portion of the support frame of FIG. 3.
Figure 5:
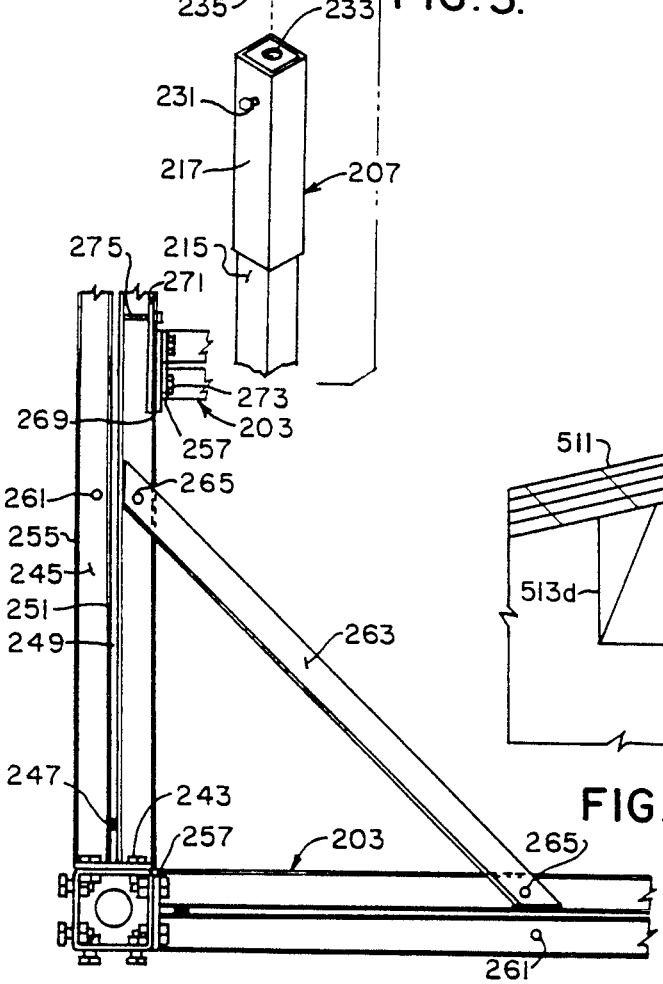
FIG. 5 is a sectional view in top plan of the support frame of FIG. 3.

Referring now to the drawings and in particular to FIG. 1, reference numeral 1 indicates one illustrative embodiment of building structure of the present invention.

The structure 1 includes a base frame 2, a modular deck 3, a modular floor 4, a modular arch portion 5, modular vertical walls 6, modular cladding shingles 7, and modular inner finish panels 8. These elements may be assembled into a multitude of arrangements, a typical arrangement being shown in FIG. 1.

The base frame 2 includes vertical uprights 201 and horizontal joists 203. As shown in FIGS. 2–5, each upright 201 includes a foot pad 205, an adjustable jack portion 207, and a framing node 209. Some uprights may also include an extension node 211.

The foot pad 205 is formed of two square pieces of three-quarter inch plywood, treated to resist rotting and insects, and bonded face-to-face to produce a pad two feet square and 1.5" thick. A nut 212 is secured in a central bore through the pad 205. Holes drilled through the pad at a 45° angle accept steel rods 213 which are driven into the soil to anchor the pads 205. It will be understood that other anchors, such as rock anchors or dead-man anchors, may be provided in accordance with known anchoring techniques for particular soil conditions.

The adjustable jack 207 includes a lower part 215 telescoped into an upper part 217. The lower end of the lower part 215 includes a bolt 219 having a plate 221 welded to it, for rotatably mounting the jack to the foot pad 205, through a vertical hole in the center of the foot pad 205. The opening in the bottom of the lower part 215 is oversized, to permit the jack 207 limited tilt with respect to the plane of the foot pad 205. The upper end of the lower part 215 carries a fixed nut 223. The upper part 217 carries a rotatable threaded vertical rod 225, threaded into the nut 223. The upper end of the rod 225 includes a gear 227, for rotating the rod 225 by means of a spur gear 229 carried by a headed adjustment bolt 231. The jack provides a vertical adjustment of up to eight inches, from a height of 24" to a height of 32". It will be seen that the adjustment bolt 231 permits the height of the jack to be adjusted without rotating the jack. A nut 233 is welded to the upper end of the upper part 217.

The extension node 211 is eight inches tall. It includes a threaded stud 235 at its lower end, for attachment to the nut 233 of the jack 207, and a nut 237 at its upper end.

The framing node 209 is also eight inches tall and 3.5 inches square. It includes a threaded stud 239 at its lower end for attaching the node 209 to the nut 233 in the jack 205 or to the nut 237 of the extension node 211. At its upper end, it includes a nut 241 of the same size as the nuts 233 and 237, for attachment of deck railings, not shown. The four vertical sides of the framing node 209 each include two captive bolts 243.

The horizontal joists 203 are formed from two C-shaped high-strength steel channels 245 welded back-to-back with spacers 247 between them to form a slot 249. Each C-shaped channel 245 is formed of fourteen gauge cold-rolled high-strength steel and includes a vertical web portion 251 and a pair of horizontal flanges 253 having reentrant 0.625" lips 255. The channels are separated by one-quarter inch. Vertical attachment plates 257 are welded to the ends of each joist 203. Each attachment plate includes a pair of keyhole openings 259 for attachment of the joist to the bolts 243 on the framing node 209 of the upright 201. The joists 203 have a length of 86.875", a width of 3.5", and a height of 8.0".

Holes 261 are provided in the lower flanges 253 of the joist 203, spaced 16.25" from the ends of the joist. A corner brace 263, formed as an angle iron, includes downwardly extending pins 265 near its ends, spaced 24.125" from each other. The pins 265 are long enough to extend into the holes 261, for squaring the frame 2.

A joist hanger 267 includes a hanger plate 269 and a smaller attachment plate 271 welded behind it. The hanger plate 269 has captive bolts 273 corresponding in size and positioning to the bolts 243 of the framing node 209. The attachment plate 271 includes a set screw 275. The joist hanger 267 is attached to a joist by inserting it into the C-shaped channel with the hanger plate 269 resting on the lower lip 255 and the attachment plate 271 abutting the inner vertical face of the lower lip 255, and tightening the set screw 275 against the web 251.

The deck 3 is installed directly over the frame 2. Preferably, the deck 3 is made of decking plank modules 301. To support the deck modules 301, intermediate joists 203 are suspended between the mid-points of parallel joists 203 in the deck area as needed. A spline 303 (FIG. 3) inserted into the slot 249 between channels 247 extends above the joists 203 and positions the deck modules 301.

Steps 305 are provided for access to the deck 3. The steps 305 include support pipes 307 attached to the frame joists 203, and treads 309 supported between the pipes 307.

The modular floor 4, arch portion 5, and vertical walls 6 are formed of hollow boxes attached to each other to form the body of the structure 1. The walls of the boxes are preferably formed of an engineered wood product including wood fiber and a waterproof resin adhesive. In the preferred embodiment the walls are formed of exterior grade plywood, and its multiple waterproof adhesive layers therefore form a vapor barrier. Except as noted, the plywood is all five-ply one-half inch thick plywood.

Each box is constructed as a plywood skin with wood blocking strips glued and stapled along and within at least some of the edges of the box. The blocking strips are conveniently cut from two-by-four or two-by-six boards of the appropriate length. This approach permits the two halves of a board to be used as blocking strips along edges which form supplementary angles. Hardware is provided along at least some of the edges of the boxes. Where blocking strips are not provided under the hardware, plywood blocks are attached to the inner faces of the plywood skin. The plywood blocks are spaced from the edge sufficiently to position the skin with respect to the orthogonal walls of the box.

The hollow boxes may be filled with various forms of insulation, such as fiberglass, polyurethane foam, and phenolic foam. The boxes are sized to provide an insulative value of about R-35 with a fiberglass fill and up to about R-80 with a full phenolic foam fill. Combinations of fills, or omission of any fill, may be utilized as dictated by climate and cost considerations. For clarity, the insulative fill is not shown in the drawings.

Because the structure is enclosed by the boxes, without any frame, and because the boxes are made of wood, the structure lacks any substantial thermal conduction paths between exterior and interior. The boxes may either abut each other directly or may be faced with resilient, closed-cell foam sheet gasketing on at least some of their abutting faces.

Figure 6:
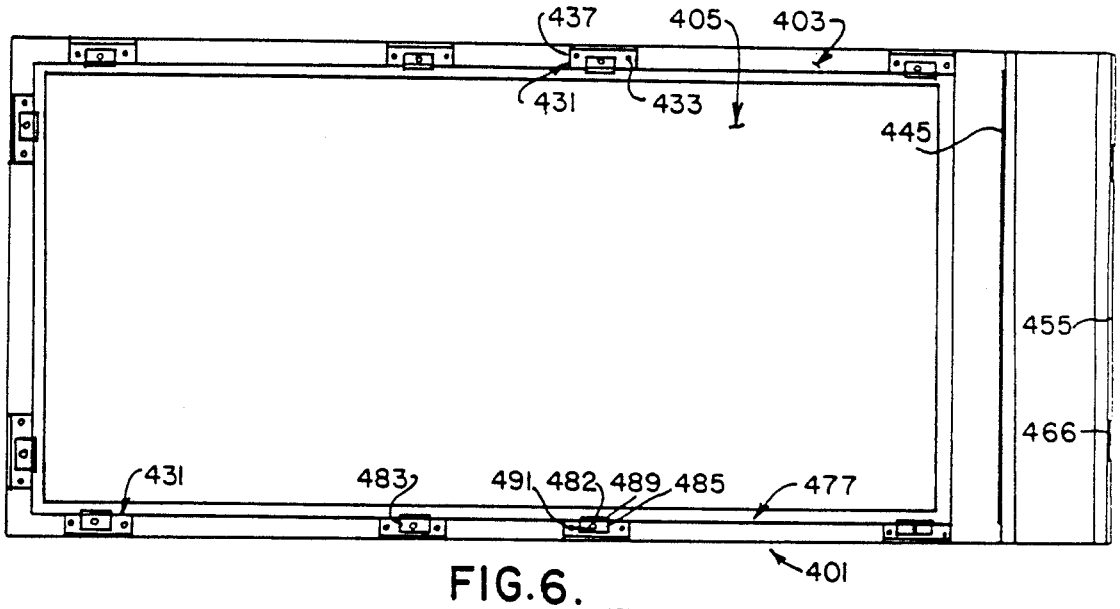
FIG. 6 is a top plan view of a floor module of the structure of FIGS. 1 and 2.
Figure 7:
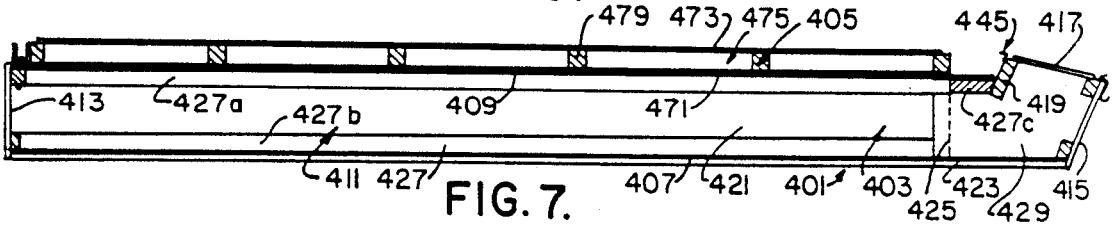
FIG. 7 is a longitudinal sectional view of the floor module of FIG. 6.
Figure 8:
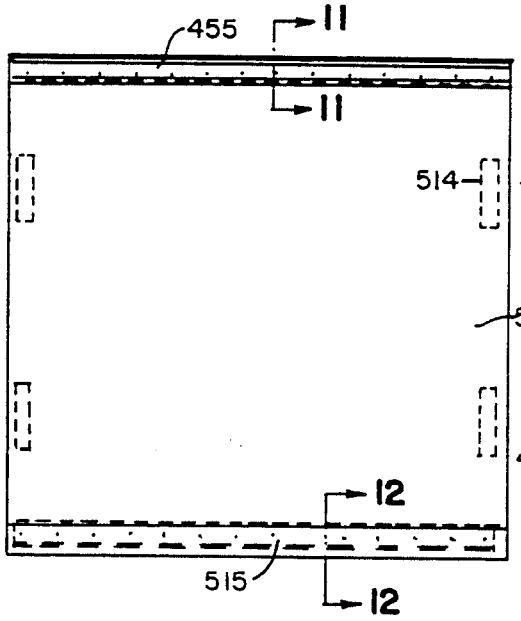
FIG. 8 is a view in outside elevation of an arch module of the structure of FIGS. 1 and 2.

The floor 4 is made of identical floor modules 401, each in the form of a hollow plywood box 403 with a pallet 405 on its upper face, as shown particularly in FIGS. 6 and 7. Each module 401 is 45.0" wide by 100.375" long by 11.25" deep. The modules 401 are so sized that the entire floor of the structure 1 may be formed entirely of the modules, regardless of the size or shape of the structure. Therefore, the floor is easily laid out and may be pre-insulated to any desired degree. The boxes 403 and pallets 405 are preferably shipped and installed separately to reduce the weight which must be handled in erecting the structure 1.

Each box 403 includes a horizontal lower wall 407, a horizontal upper wall 409, a pair of parallel side walls 411, a vertical center end wall 413, an outwardly sloping prow end wall 415, a downwardly sloping arch-support wall 417, and a connecting wall 419. The lower wall 407 is a 44.0" by 96.0" rectangle made of one-quarter inch plywood, and the upper wall 409 is a 45.0" by 88.656" rectangle made of three-eighth inch plywood. The upper and lower walls are separated by 8.0". The side walls 411 are made in two pieces: a rectangular sheet 421 of plywood 8.75" tall by 85.28" long and a prow end plywood piece 423, joined as indicated by the line 425 in FIG. 7. The center end wall 413 is a 8.75" by 45.0" rectangle. The prow end wall 415 is a 8.813" by 45.0" rectangle. The arch-support wall 417 is a 9.75" by 45.0" rectangle. The connecting wall 419 is cut from a 44.0" long two-by-six board. The prow wall 415 slopes outwardly from the lower wall 407 at an angle of 115.714°, and the arch-support wall 417 forms an angle of 77.143° with the prow wall 415. The prow wall 415 and the connecting wall 419 are parallel to each other.

Blocking strips 427 are glued and stapled along and within all horizontal edges of the plywood skin of the box 403. Reinforcing panels 429, made of three-quarter inch plywood, are adhered to the inner faces of the prow ends 423 and the outboard ends of the rectangular sheets 421 of the side walls 411. The reinforcing panel 429 is of the same general shape as the side wall 411, but its upper face is cut to accommodate the lower end of connecting wall 419 and a blocking strip 427, and its lower edge is spaced upwardly from the lower edge of side wall 411 and acts as a blocking strip for the lower wall 407.

Figure 14:
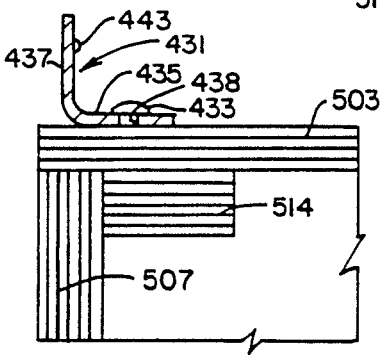
FIG. 14 is a sectional view taken along the line 14—14 of FIG. 9.
Figure 15:
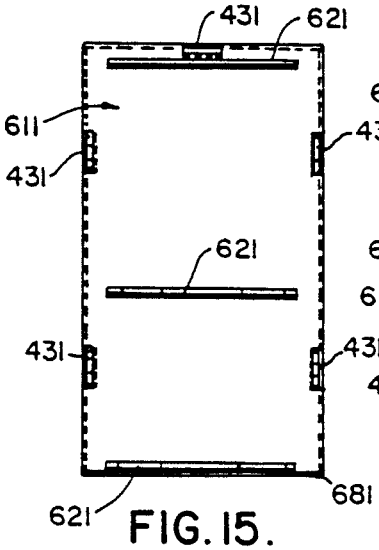
FIG. 15 is a view in outside elevation of a rectangular end closure module of the structure of FIGS. 1 and 2.
Figure 16:
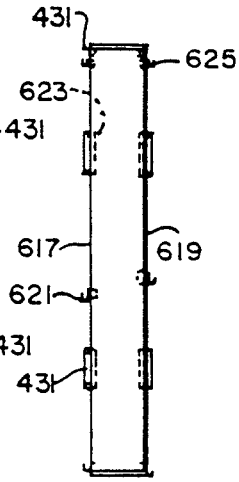
FIG. 16 is a view in right side elevation of the end closure module of FIG. 15.
Figure 17:
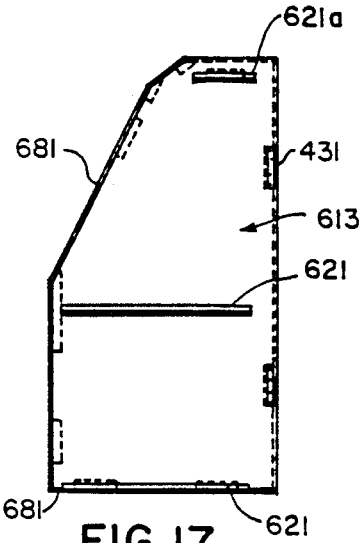
FIG. 17 is a view in outside elevation of a lower side end closure module of the structure of FIGS. 1 and 2.
Figure 18:
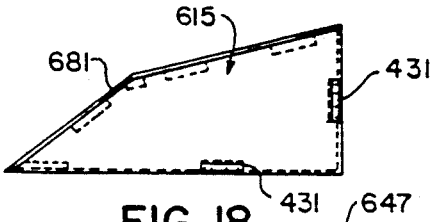
FIG. 18 is a view in outside elevation of an upper end closure module of the structure of FIGS. 1 and 2.
Figure 38:
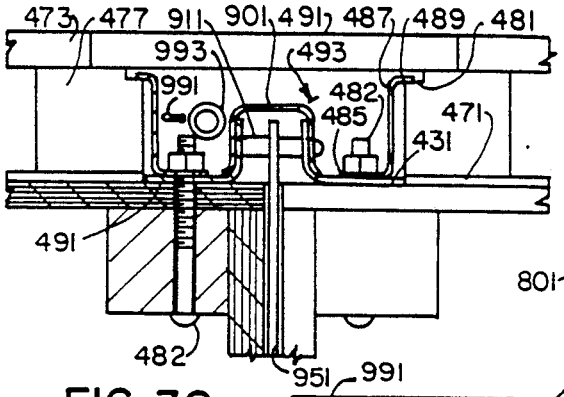
FIG. 38 is an assembly detail of the floor area indicated by the line 38—38 of FIG. 29.
Figures 51, 52, 53, 54:
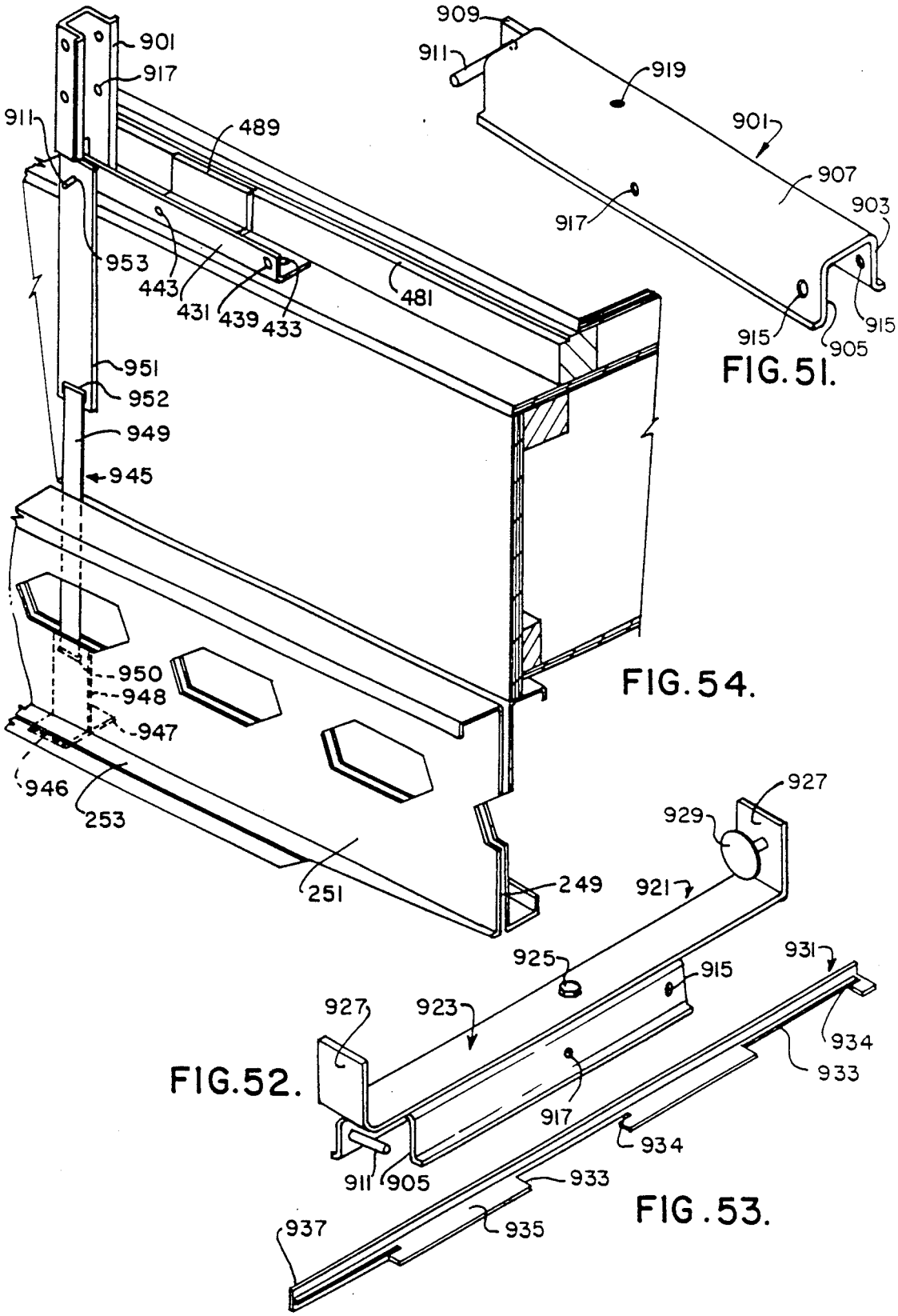
FIG. 51 is a view in perspective of a connector clip for use in assembling the structure of the FIG. 1.
FIG. 52 is a view in perspective of a modified connector clip of FIG. 51, for use at ends of a vault section of the structure of FIG. 1.
FIG. 53 is a view in perspective of a clip for holding finish trim pieces to the inside of the structure of FIG. 1.
FIG. 54 is a view in perspective, partially broken away, showing an attachment strap and the connector clip of FIG. 51 being used in assembling the floor of the structure of FIG. 1 to a base frame.

Along three sides of the top wall 409, module connectors 431 are held to the floor by screws 433. The connectors 431 are shown in more detail in FIGS. 14, 38, and 54. The connectors 431 are eight-inch long 90° angle irons, formed of twelve-gauge galvanized high-strength steel and having a 1.25" horizontal fixed leg 435 and and a 0.906" vertical free leg 437. Four holes 438 are formed in the horizontal leg 435 for screwing the connector 431 to the floor. Holes 439 FIG. 54 are formed 0.25" from the ends of the vertical leg 437 of the connector 431. A central hole 441 is also formed in the horizontal leg 435, and a central detent 443 is formed in the vertical leg 437. The inboard faces of vertical legs 437 of the module connectors 431 are set back from the edge of the floor module 403 by 0.406", sufficient to permit clipping adjacent modules, separated by a gasket, to each other as described hereinafter.

Figure 9:
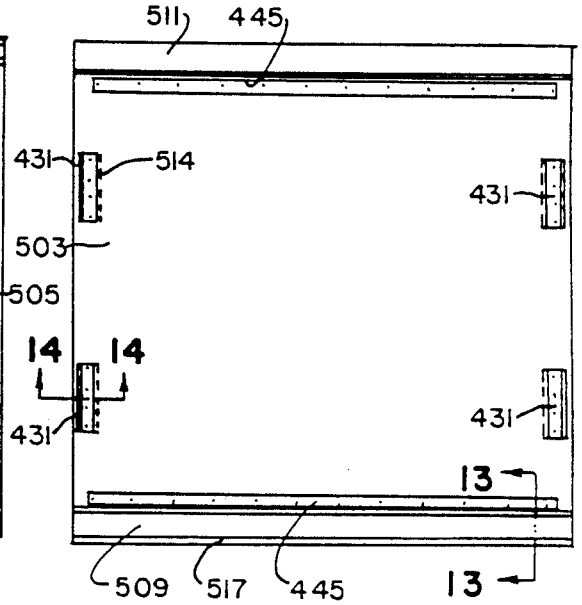
FIG. 9 is a view in inside elevation of the arch module of FIG. 8.
Figure 12:
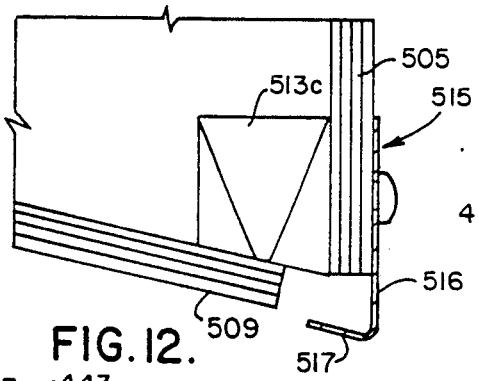
FIG. 12 is a sectional view taken along the line 12—12 of FIG. 8.
Figure 13:
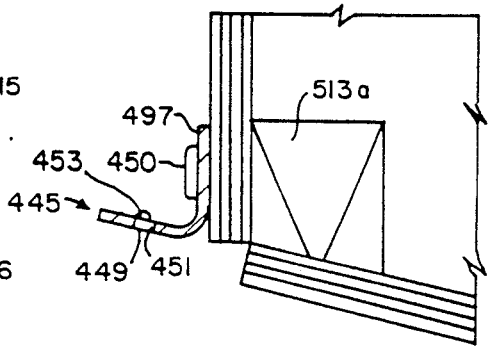
FIG. 13 is a sectional view taken along the line 13—13 of FIG. 9.

Along the upper edge of the connecting wall 419 is an arch connector rail 445. The rail 445 is shown in more detail in FIGS. 9, 13, and 39. The arch connector rail 445 is a 42.0" long angle iron having a 1.25" attached leg 447 and a 0.906" free leg 449, bent at an angle of 77.143° to each other. The leg 447 attached to the connecting wall 419 includes holes for attaching the rail 445 to the wall 419 with screws 450. The free leg 449 includes three sets of holes 451 and detents 453, corresponding to the holes 439 and detents 443 of the module connectors 431, at the ends and center of the rail 445. The free leg 449 also includes other holes for attaching auxiliary pieces and utility lines.

Along the upper edge of the prow wall 415 is a cove rail 455. The cove rail 455 is 45.0" long and is made of fourteen gauge galvanized high-strength steel. It has a 2.094" attachment leg 457, a 0.75" inboardly directed upper leg 459, bent at an angle of 90° to the attachment leg, a 0.75" free cove leg 461, bent at an angle of 12.857° to the upper leg 459, an outboardly bent lower leg 463 bent at an angle of 90° to the attachment leg 457, and an upwardly extending free leg 465 for attachment of cladding 7. The attachment leg 457 is attached to the prow wall 415 by fourteen screws extending through holes in the attachment leg 457. The lower face of the cove leg 461 is parallel to, and extends 0.125" below, the upper surface of the arch-support wall 417. At two places, 3.0" sections 466 of the free leg 465 are cut and bent inwardly for alignment of the cladding.

A galvanized high-strength steel channel 467 is attached with staples onto the lower edge of the side wall 411, spaced 4.0" from the prow wall 415. The channel 467 acts as a bearing surface on the base frame 2.

Each pallet 405 includes a horizontal lower wall 471 and a horizontal upper wall 473, separated by a frame 475 made of two long boards 477 and six cross boards 479. The lower wall 471 is a 41.5" by 84.031" rectangle made of one-eighth inch plywood and the upper wall 473 is a 40.0" by 82.531" rectangle made of three-eighth inch plywood. The frame 475 is formed of 1.5" by 1.5" boards and has the same dimensions as the lower wall 471. The upper periphery of the frame 475 includes a rabbet 481.

Along three sides of the pallet 405, pallet connectors 483 are held to the floor by bolts 482 extending upwardly through the blocking strips 427 and through the central holes 441 in the module connectors 431. The pallet connectors 483 are in the form of Z-clips having a lower horizontal leg 485, a vertical leg 487, and an upper horizontal leg 489 which engages the rabbet 481 of the pallet frame 475. A slot 490 in the lower leg 485 permits the pallet connector 483 to be moved outboardly for field installation of the pallet 405 on the floor module box 403. The bolts 482 also function to strengthen the attachment of the module connectors 431 to the box 403, and thereby strengthen the assembled floor 4.

Cover strips 491 are provided between pallets, to cover the grid of raceways 493 formed between the pallets on adjacent floor modules 401. Cover strips 495 are also provided for covering the raceways 493 formed between the pallet and the connecting wall 419.

The modular arch portion 5 of the structure 1 is formed of identical arch modules 501, as shown particularly in FIGS. 8-14. Each module 501 is in the form of a regular six-sided trapezoidal prism or voussoir, having (exclusive of hardware) a width of 45.0", an effective inside height of 41.0", an effective outside height of 46.0" and a depth of 11.0". Four of the modules are stacked and connected to each other to form a half-arch section. Two facing half-arch sections, formed of eight stacked arch modules 501 form a full arch section. The modules 501 form facets of a regular fourteen sided figure (tetradecagon). Because the arch support wall 417 slopes outwardly downward, forming a portion of the next facet of the tetradecagon, the lowermost module of the half arch is vertical. The half arch has an exterior height of about 138.0" and an exterior width of about 102.0". The full arch is twice as wide.

The tetradecagonal configuration provides a remarkable amount of usable space within the structure 1. The second module 501 of the half arch reaches an interior height of 72.0" less than 18.0" inboard from the vertical first module, and the maximum interior height of the structure is about 112.0", less interior finish. The interior width of the half arch is about 90.0" and of the full arch is about 180.0".

The arches are secured side-to-side to form axially extending barrel vaults and half barrel vaults. The length of the vault is a multiple of the 45.0" width of the arches and may be extended indefinitely.

Figure 11:
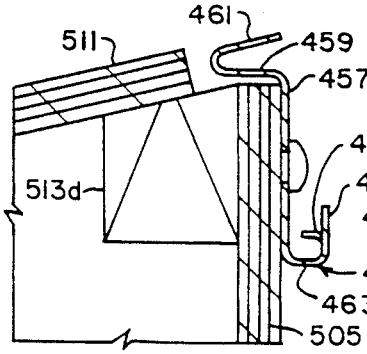
FIG. 11 is a sectional view taken along the line 11—11 of FIG. 8.
Figure 10:
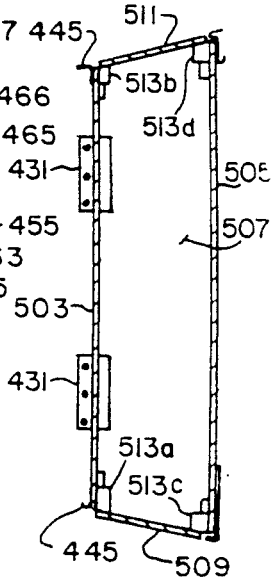
FIG. 10 is a view in side elevation of the arch module of FIGS. 8 and 9.

Each arch module 501 includes rectangular interior and exterior walls 503 and 505, a pair of trapezoidal side walls 507 made of three-quarter inch plywood, and lower and upper convergent end walls 509 and 511. The interior wall 503 is a rectangle having a width of 45.0" and a height of 40.188". The exterior wall 505 is a rectangle having a width of 45.0" and a height of 44.75". The trapezoidal side walls 507 are regular trapezoids having a small base of 40.188", a large base of 44.75", and a height of 10.0". The sides of the trapezoid form an angle of 77.143° with the large base and have a length of 10.256". The end walls 509 and 511 are 9.75" by 45.0" rectangles. Blocking strips 513 are glued and stapled to the inside surfaces of the four horizontal edges of the module 501. The end walls are positioned at the interior edge of the module, exposing a part of the exterior blocking strips 513 as shown in FIG. 11. Four plywood blocks 514 are adhered to each of the interior and exterior walls 503 and 505 for positioning the walls with respect to the side walls 507.

Along the upper and lower horizontal edges of the inner wall 503 are arch connector rails 445, identical with the rail 445 on the floor module box 403. The inboard edge of each rail is set back 0.5" from the plane of the outside face of the end panel 509 or 511, to provide for clipping together the rails 445 of adjacent modules 501 in each arch or half arch.

Along each vertical edge of the inner wall 503 are two module connectors 431, identical with the module connectors 431 of the floor box 403. The module connectors are held to the plywood blocks 514 by screws and the inboard faces of free legs 437 of the module connectors 431 are set back from the edges of the module 501 by 0.406", sufficient to permit clipping adjacent modules in adjacent arches, separated by a gasket, to each other as described hereinafter.

Along the lower horizontal edge of the outer wall 505 is a hook rail 515. The hook rail 515 is a 45.0" long angle iron made of fourteen gauge high strength galvanized steel. It has a 2.5" attached leg 516 and a 0.75" free leg 517 bent at an angle of 77.143° to each other. The leg 516 is attached to the module wall 505 by twelve screws. The upper face of the free leg 517 is parallel to, and extends 0.063" below, the plane of the outer face of the lower end wall 509.

Along the upper horizontal edge of the outer wall 505 is a cove rail 455, identical with the cove rail 455 of the floor box 403. The lower face of the cove leg 461 is parallel to, and extends 0.125" below, the upper surface of the upper end wall 511.

When the arch modules are connected to each other, the cove and hook interconnect and tension the outer wall 505 of the module 501.

The vertical walls 6 are utilized in two ways: as end closures 601 for half arch and full arch sections, and as axially extending walls for half arches. By the use of a special set of vertical wall modules, the shape (floor plan) of the structure may be made quite complex.

The vertical wall modules are all formed to the size of the interior and exterior wall pieces, with the side and end walls within and flush to the perimeter of the interior and exterior walls. The side and end walls are therefore in the nature of ribs. The broad interior and exterior walls include blocks 514 around their periphery, for positioning the ribs with respect to the broad walls and for reinforcing hardware mounted near their periphery. The blocks are shown in broken lines in some of FIGS. 15-28.

The inside walls of the vertical wall modules are formed of one-half inch plywood, the outside walls are formed of one-quarter inch plywood, and the ribs are formed of three-quarter inch plywood. The ribs are all 9.75" wide, so that the depth of the boxes is 10.5" not including hardware, or 12.875" with hardware. Because the inside and outside walls of the vertical wall modules are different, many of the vertical modules are mirror images of each other.

By symmetry, the half arch modules always exist in mirror-image pairs, either as the opposite ends of half arches or as the two sides of the end of a full arch.

The half arch end closure consists of three modules: a large rectangular central module 611, an irregular side module 613, and an irregular upper module 615.

Figure 45:
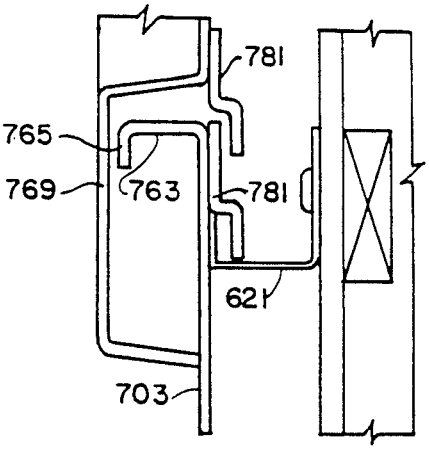
FIG. 45 is an assembly detail of the connection of cladding shingles over a half-arch section of the structure, in the area indicated by the line 45—45 of FIG. 2.

The central module 611 is 82.0" tall by 45.0" wide. Module connectors 431 are mounted on both its exterior wall 617 and its interior wall 619, two on each vertical edge and one on the top edge. The inboard face of the free arm 437 of the connector 431 is spaced 0.406" from the edge of the module 611 to permit the module to be clamped to another wall module with intermediate gasketing. On the exterior wall 617 of the module 611 are mounted three horizontal J-shaped strips 621, each 36.0" long, with a 1.5" tall fixed leg 622, a 1.88" wide horizontal leg 623, and a 0.563" tall free vertical leg 624. The strip 621 is shown particularly in FIG. 45. The long arm of the J is screwed through the wall 617 into blocks 549 glued to the inside face of the wall 617. The strips 621 support cladding 7 as described hereinafter. On the interior wall 619 of the module 611 are mounted two eight-inch long J-shaped strips 625, one at the center of the wall 619 and the other at the bottom edge of the wall 619. The strips 625 have the same cross-section as the strips 621. The strips 625 support interior finish panels 8 as described hereinafter.

The irregular side module 613 is similar to the central wall module 611. It is 82.0" tall by 42.813" wide. It includes an 80.5" tall inboard vertical rib 627, an 18.312" long horizontal top rib 629, a 9.031" long first outboard rib 631, a 40.188" second outboard rib 633, and a 40.156" vertical outboard rib 635. The outboard side of the module 613 is shaped to fit the interior of an arch formed from arch modules 501, but to be spaced inwardly from the inner face of the arch by about 1.5". Adjacent its vertical rib 627, the module 613 includes two connectors 431 on both its interior and exterior walls, at the same positions as the connectors on the vertical edges of the module 611 for connection to that module. On the exterior wall of the module 613 are mounted three horizontal J-shaped strips 621, aligned with the strips 621 on the central module 611. The upper J-strip 621*a* is shorter than the other strips 621. On the interior wall of the module 613 are mounted two J-shaped strips 625, aligned with the strips 625 on the central module 611.

The irregular upper module 615 is 28.375" tall and 63.5" long. It includes a 27.594" vertical rib 637, a 40.156" long top outboard rib 638, a 29.906" second outboard rib 639, and a 63.5" horizontal rib 640. The second outboard rib 639, together with the beveled end of the horizontal rib 640, forms a continuation of the first outboard rib 633 of the module 613. The outboard side of the module 615 is also shaped to fit the interior of an arch formed from arch modules 501, and to be spaced from the inner face of the arch by about 1.5". Adjacent its vertical rib 637, the module 615 includes a connector 431 on both its interior and exterior walls. It also includes connectors 431 adjacent its horizontal rib 640, aligned with the connectors on the top edge of the module 611 for connection to that module.

A stapling strip 681 is provided along the edges of the end closure modules which abut the floor 4 and the arch modules 501. The stapling strip 681 is 1.188" deep, to correspond to the depth of the J-strips 621. The stapling strips 681 are utilized in providing a gasket around the end closure as described hereinafter.

The half arch vertical wall sections include four rectangular modules (and mirror images of two of them) to construct a half vault, a column module (and its mirror image) to join a half arch to a full arch in axial alignment, and three special purpose modules (and their mirror images) for joining the axial end of a full arch orthogonally into a vertical wall of a half vault.

The rectangular vertical wall sections needed to construct a half vault include the central module 611 of the end closure, a shorter upper module 645 for use above the module 611, a lower end module 655 for interconnection to the end closure modules, and an upper end module 657 for use above the module 655.

The central module 611 may be used without change as the major portion of a vertical wall which completes each half arch of a half vault portion of the structure 1.

Figure 19:
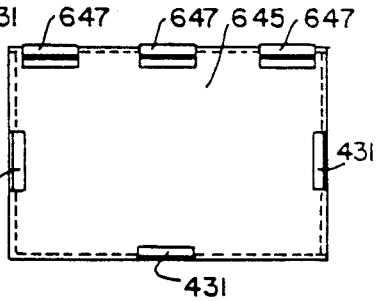
FIG. 19 is a view in outside elevation of an upper vertical wall module of the structure of FIGS. 1 and 2, for use in the vertical side wall of a half-arch portion of the structure.

The upper module 645, shown particularly in FIG. 19, is positioned directly above the module 611. It is 30.0" tall by 45.0" wide. On both its exterior and interior walls it includes a connector 431 at the center of its two vertical side edges and its lower horizontal edge.

Figure 44:
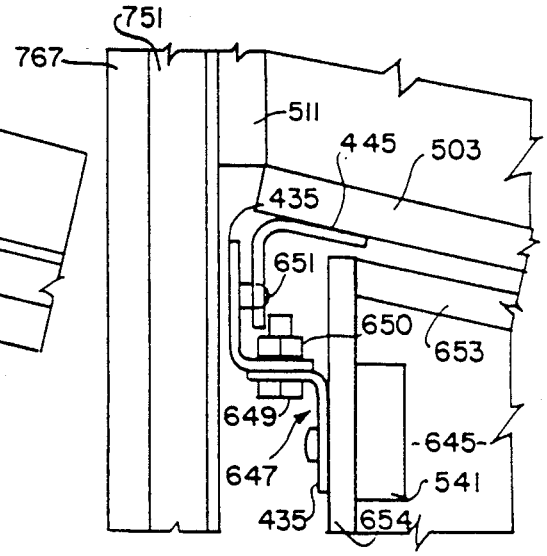
FIG. 44 is an assembly detail of the connection of an arch module and a half arch module at the ridge of the structure, and the associated exterior details, in the area indicated by the line 44—44 of FIG. 2.

As shown particularly in FIG. 44, the upper wall 653 of the upper module 645 forms an angle of 77.143° with respect to the exterior wall 654 of the module 645.

As also shown in FIG. 44, on the upper edge of the outer face of upper module 645 are three orthogonal connectors 647. Each orthogonal connector 647 consists of two connectors 431 with their free arms 437 held to each other by a pair of bolts 649 and captive nuts 650. The fixed leg 435 of the lower connector 431 of the orthogonal connector 647 is screwed to the module 645 and the "fixed" leg 435 of the upper connector 431 is spaced from and parallel to the outer face of the module 645. Two inwardly-extending pins 651 are fixed in the openings of the upper leg 435 of the orthogonal connector 647, for locking the upper vertical module 645 to the arch connector rail 445 of the upper arch module 501, to form a half arch of a half vault section of the structure 1 as described hereinafter.

Figure 21:
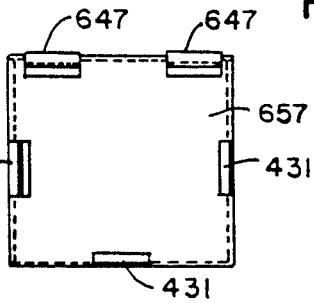
FIG. 21 is a view in outside elevation of a narrowed vertical wall module of the structure of FIGS. 1 and 2, for use over the module of FIG. 20.
Figure 20:
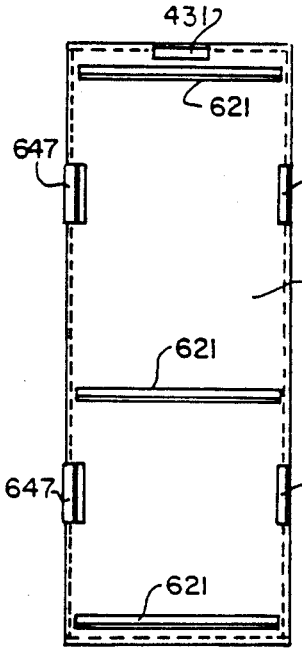
FIG. 20 is a view in outside elevation of a narrowed vertical wall module of the structure of FIGS. 1 and 2, for use at an end of the vertical side wall of a half-arch portion of the structure.
Figure 22:
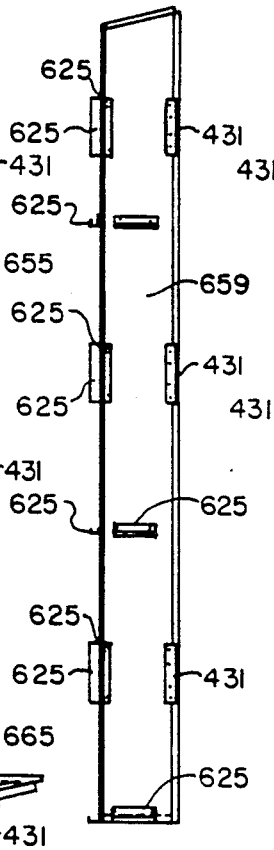
FIG. 22 is a view in side elevation of a square interior corner post module of the structure of FIGS. 1 and 2.

The other two rectangular half arch modules 655 and 657 are used at the ends of a half vault. They are shown in FIGS. 20 and 21, respectively. They differ from the rectangular modules 611 and 645 in being 33.125" wide rather than 45.0" wide, and in substituting orthogonal connectors 647 for the connectors 431 on one vertical exterior edge of the modules 655 and 657. As shown in FIG. 2, the end closure modules 611 and 615 extend to the edge of the half vault section. The vertical end modules 655 and 657 are therefore narrower than the modules 611 and 645 by an amount equal to the thickness of the end closure modules and their set-back from the outer edge of the floor 4.

Figure 48:
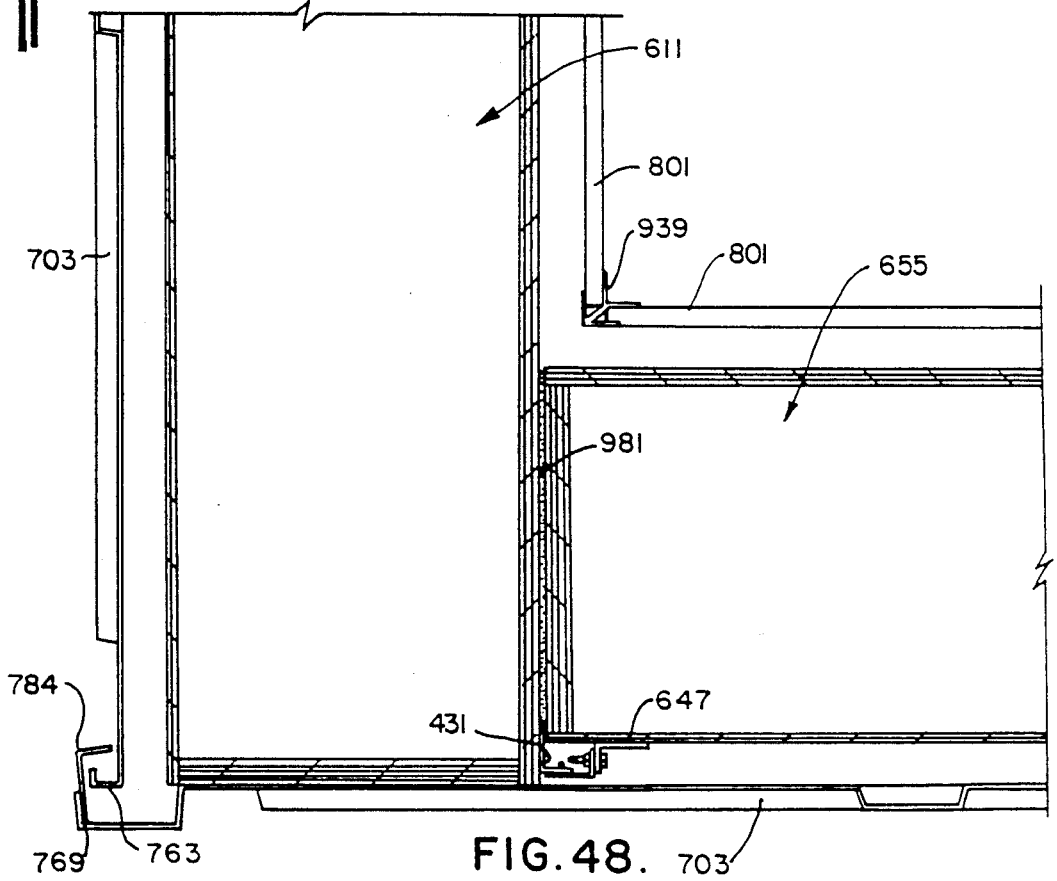
FIG. 48 is a sectional assembly detail in plan view of an outside corner connection of an end closure module and a vertical half arch module of the structure.

The orthogonal connectors 647 on the vertical edges of the end modules 655 and 657 engage the module connectors 431 on the vertical exterior walls of the rectangular end closure module 611 and the upper end closure module 615, as shown in FIG. 48. Because it is narrower than the upper panel 645, the upper panel 657 includes only two orthogonal connectors 647 on its upper edge for locking the upper vertical end module 657 to the arch connector rail 445 of the upper arch module 501.

It will be seen that opposite ends of a half barrel vault require end modules 655 and 657 which are mirror images of each other.

Figure 49:
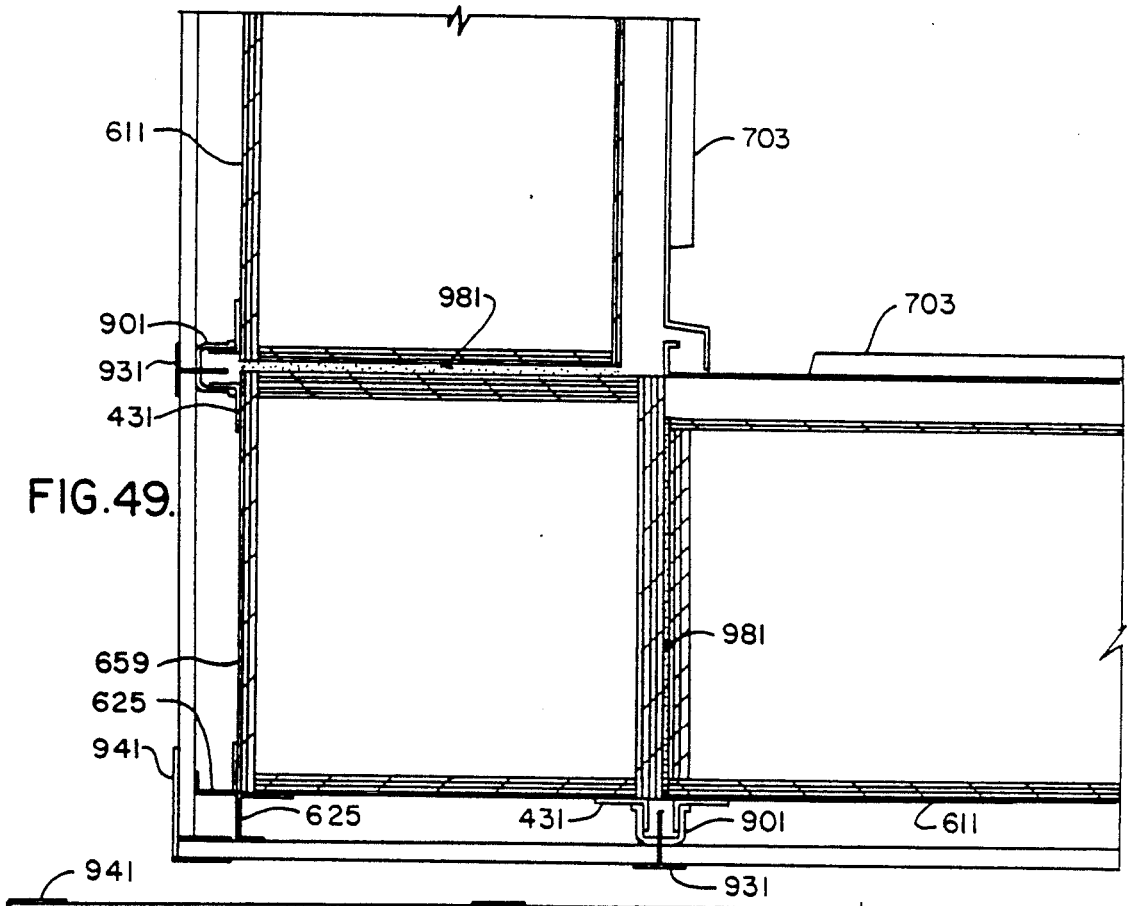
FIG. 49 is a sectional assembly detail in plan view of an inside corner connection of an end closure module and a vertical half arch module of the structure.

As has been mentioned, the present structure has the ability to attach a full arch section either axially to a half arch section (where one half arch section is continuous and the other half of the full arch is terminated in an end closure wall) or orthogonally to a vertical wall of a half arch. The first type of attachment is particularly adapted to forming entry chambers at doors. The second type of attachment allows the structure to "turn the corner" and form a multitude of distinctive and attractive interior layouts. The area of intersection, where floor modules 401 are layed at right angles to each other on the base support frame 2, is particularly open and spacious.

Where a full arch section meets a half arch section which is axially aligned with it, as by the door 691 in FIG. 1, a column module 659 is required to fill the gap between the vertical half-arch walls 611 and 645 (or walls 655 and 657) and the vertical edges of the rectangular end closure module 611 and the upper end closure module 615, as shown in FIG. 49. The column module 659, shown in FIG. 22, includes eight-inch long J-shaped strips 625 on each side of one vertical edge of the module 659, and includes module connectors 431 on the other vertical edges of the walls to which the J-strips 625 are attached. The J-strips act as set-offs for interior finishing panels 8, and the module connectors attach the column module 659 to adjacent modules 611 and 615 in the end closure wall and to adjacent modules 611 and 645 (or 655 and 657) of the half arch vertical wall. Horizontal J-strips 625 are also provided on the same two (interior) walls, aligned with the J-strips 625 on the adjacent interior walls.

It will be seen that at the opposite end of the full barrel vault, like the vertical wall visible through the cut-away portion of FIG. 1, a column module is required which is the mirror image of the column module 659.

Figure 29:
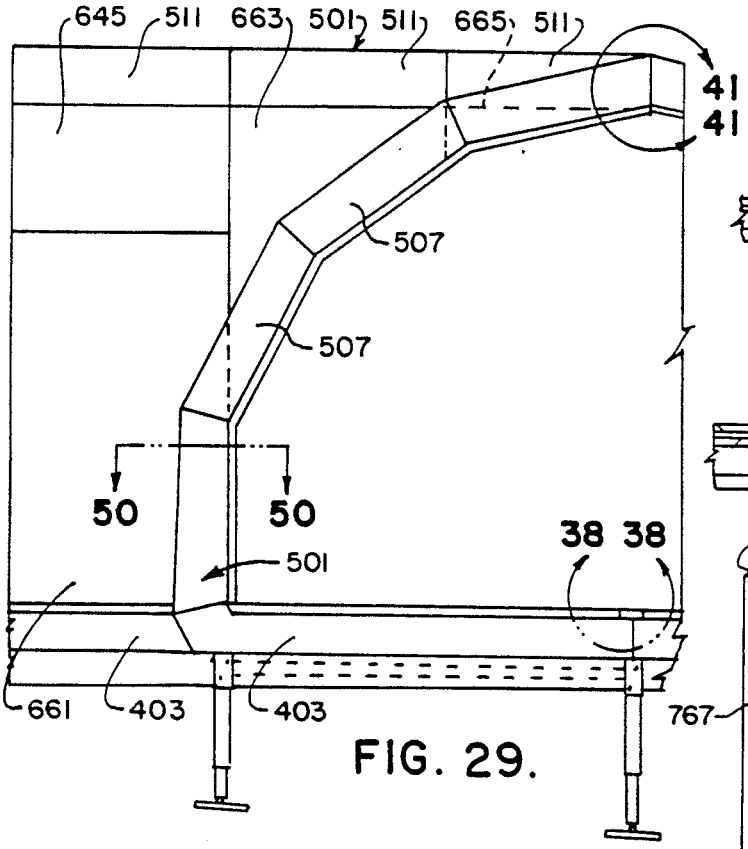
FIG. 29 is a somewhat diagramatic sectional view, taken along the line 29—29 of FIG. 1, showing the use of the modules of FIGS. 23-28 in joining a full arch portion and a half arch portion of the structure of FIG. 1.
Figure 50:
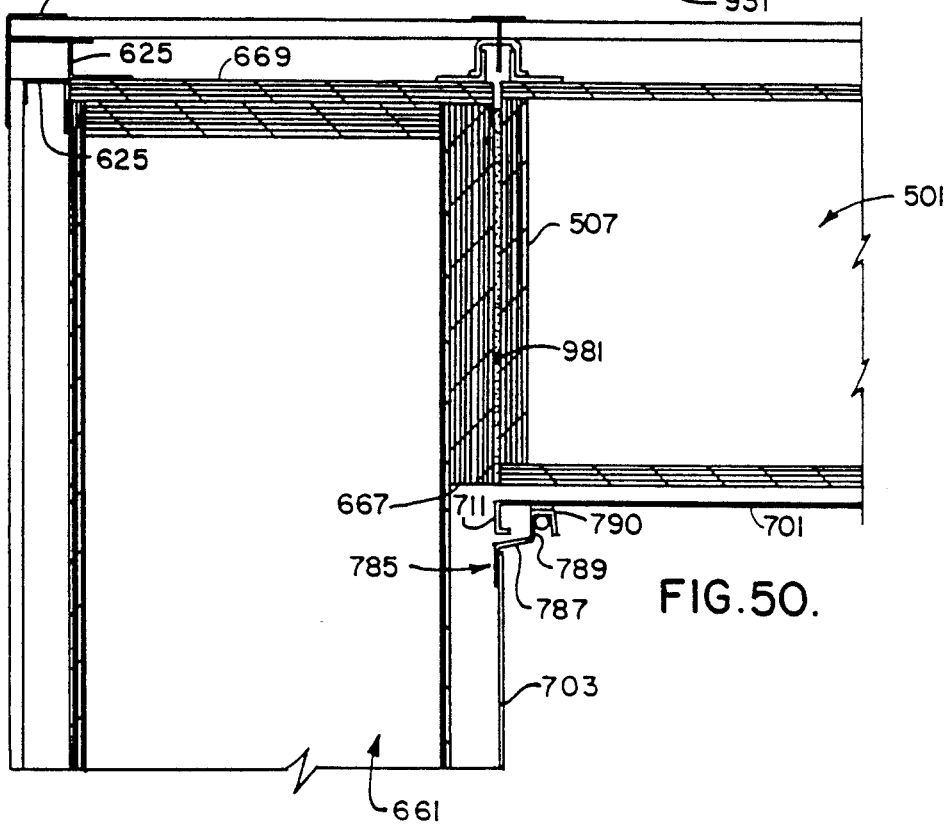
FIG. 50 is a sectional assembly detail in plan view, corresponding to a section taken along line 50—50 of FIG. 29, but with cladding shingles included, of a connection between a full arch module and a vertical half arch module of the structure, where the structure "turns a corner."

The structure 1 may be expanded indefinitely by causing a full arch section to meet a vertical wall of a half arch which is orthogonal to the full arch, as shown in the more distant portions of FIG. 1, in FIG. 29, and in FIG. 50. This "turning the corner" requires six special vertical wall modules. Three of the special modules are mirror images of the other three. Therefore, only the three distinctive modules are illustrated. The special modules are all 45.0" wide and include a rectangular module 661, an intermediate module 663, and an upper module 665. Each of the modules 661, 663, and 665 includes a portion which extends outwardly 1.25" beyond the 10.5" depth of the "ordinary" vertical half arch modules, to provide a snug fit with the end of the full arch section. This extension is required to compensate for the inset of the vertical half arch wall from the edge of the floor modules 401.

Figure 23:
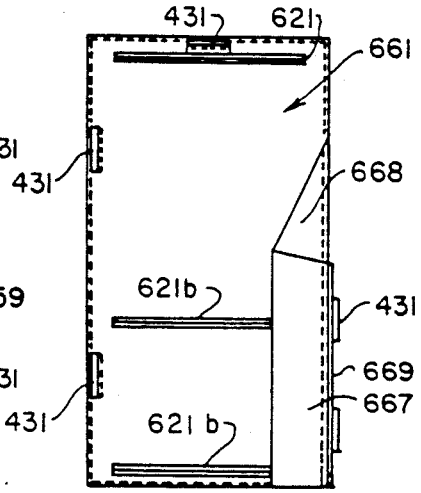
FIG.23 is a view in outside elevation of a vertical side wall of a half arch portion of the structure of FIGS. 1 and 2, for use in joining a full arch portion of the structure to the half arch.
Figure 24:
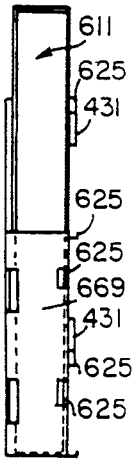
FIG. 24 is a view in side elevation of the module of FIG. 23.

The rectangular module 661, shown particularly in FIGS. 23 and 24, is similar to the rectangular module 611, but it includes plywood facing boards 667 and 668 on its outer face, along one of its vertical edges. The facing boards are 1.25" thick (preferably laminated of three-quarter-inch and half-inch plywood) and 10.5" wide. They are shaped to mate with the ends 507 of the arch modules 501. Along the vertical edge of the module 661 adjacent the facing board 667, a half-inch edging board 669 is provided to make up a slight difference between the width of four floor modules 401 placed side-by-side and the length of two floor modules 401 placed end-to-end. Module connectors 431 are provided on the edging board 669, for connection with the module connectors 431 on the arch modules 501, space being left for gasketing between the arch panel end 507 and the facing board 667.

The module 661 also differs from the "ordinary" rectangular module 611 in that the central and lower J-strips **621*b* are shortened to accommodate the facing board 667. It further differs in substituting J-strips 625 for module connectors 431 along the interior wall adjacent the edging board 669. A standard upper module 645 is used above the special module 661**.

Figure 25:
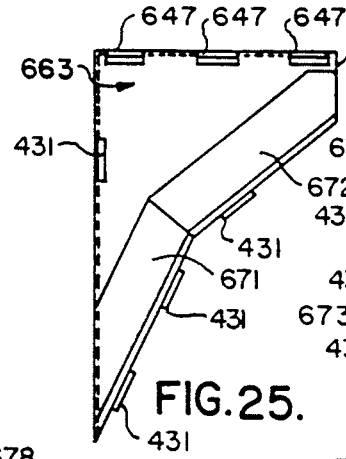
FIG. 25 is a view in outside elevation of another vertical side wall of a half arch portion of the structure of FIGS. 1 and 2, for use in joining a full arch portion of the structure to the half arch.
Figure 26:
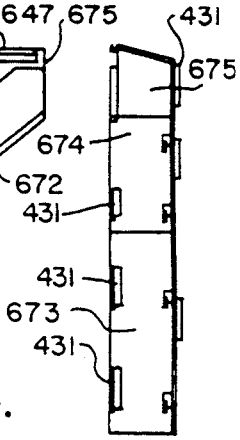
FIG. 26 is a view in side elevation of the module of FIG. 25.

The intermediate module 663, shown particularly in FIGS. 25 and 26, is designed to mate with the second full arch module 501 in an arch and with the major part of the third arch module 501. Its upper edges are the same as those of the upper module 645, including three orthogonal connectors 647 on its exterior wall. Its long vertical left edge, as viewed in FIG. 25, includes a module connector 431 on its exterior wall for connecting the module 663 to the upper module 645 above the special module 661, and also includes module connectors 431 along its interior wall for connection of the special module 663 to the special module 661 and its upper module 645. The lower and right edges of the module 663, as viewed in FIG. 25, are formed to match the second and third arch modules 501 of an arch; they include facing boards 671 and 672 corresponding to the facing boards 667 and 668 of the module 661 and edging boards 673 and 674 corresponding to the edging board 669 of the module 661. Adjacent the exterior wall of the module 663, two module connectors 431 are mounted on the edging board 673 and one module connector 431 is mounted on the edging board 674, for connecting the module 663 to the arch modules 501. Adjacent the interior wall of the module 663, J-shaped strips 625 are mounted on the edging boards 673 and 674 for mounting interior finishing 8. Adjacent a short vertical wall 675, a module connector 431 is provided on the interior wall, for connecting the module 663 to the upper special module 665.

Figure 27:
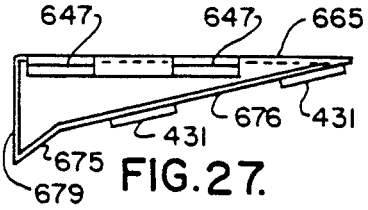
FIG. 27 is a view in outside elevation of another vertical side wall of a half arch portion of the structure of FIGS. 1 and 2, for use in joining a full arch portion of the structure to the half arch.
Figure 28:
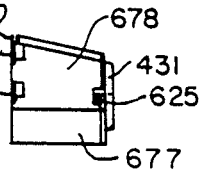
FIG. 28 is a view in side elevation of the module of FIG. 27.

The upper special module 665, shown particularly in FIGS. 27 and 28, is designed to mate with the upper end of the third arch module of an arch section and with the lower part of the fourth (upper) arch module 501. As shown in FIG. 29, the upper end of the upper arch module 501 abuts the upper wall 511 of the upper module 501 of the half arch section. The upper module 665 is thus primarily a filler module and is not required to contribute greatly to the strength of the structure. The module 665 is made 11.75" deep, to match the depth of the module 663 and its facing board 672. Its upper wall forms an angle of 77.143° with respect to its exterior wall, but no hardware is provided along the upper wall in order to permit the exterior wall to abut the end walls 509 of the arch modules 501. A lower sloped wall 677 of the module 665 is a continuation of the wall 674 of the module 663. It will be seen that one module connector 431 is omitted from this wall because the connector would extend across the modules 663 and 665; no significant loss of strength is caused by omission of this connector. An upper sloped wall 678 of the module 665 is provided with two module connectors 431 for connecting the module 663 to the upper full arch module 501. Adjacent a short vertical wall 679, a module connector 431 is provided on the interior wall of the module 665, for connection to the connector 431 adjacent the wall 675 of the intermediate special module 663.

Figure 30:
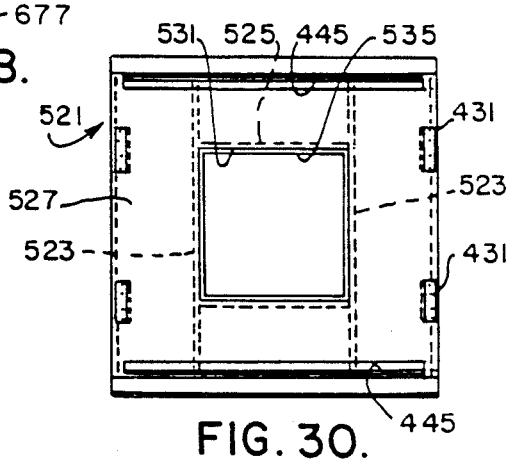
FIG. 30 is a view in inside elevation of a window arch module of the structure of FIGS. 1 and 2.

It will be understood that any of the modules may be modified to provide openings through them for various purposes. For example, the narrow rectangular module, used at the end of a half vault section is modified at the right side of FIG. 1 to include a door 681. This modification entails merely building a standard door frame within the module. Window modules are desirable for inhabited structures, and may be provided by modifying an arch module 501 as shown in FIG. 30. As shown in FIGS. 1, 2, 30, and 42, a window module 521 may be substituted for any of the arch modules 501, preferably the second arch module (the arch module above the bottom or parapet module 501). The module 521 differs from a standard arch module 501 in that vertical frame members 523 and horizontal frame members 525 define a square opening extending from the interior to the exterior of the module, and the interior and exterior walls 527 and 529 of the module are cut to expose the square opening. The vertical frame members 523 may be the same as the side walls 509 of the module 501, with corners cut out to accommodate the blocking strips 513. The horizontal frame members are also 9.75" deep, and extend between the vertical frame members 523. The size and shape of the opening is thus determined solely by the length and positioning of the horizontal frame members 525. A square opening 531 in the inner wall 527 matches the inside dimensions of the framed square, and a square opening 533 in the outer wall 529 is slightly smaller than the inside dimensions of the framed square. A steel frame 535 around the outer opening 533 holds a magnetic frame 537 of a multiple glazing 539.

The cladding shingles 7 are of three types: arch shingles 701, vertical shingles 703, and ridge shingles 705 and 706. The shingles are formed of 0.125" acrylonitrile-butadiene-styrene (ABS) thermoplastic sheet, thermoformed to the desired shapes. This material provides good protection and is easily worked. It lends itself particularly well to cutting of shapes and welding attachment tabs and special returns, either by solvent welding or by sonic welding techniques. Modifications of standard molded forms of the shingles may therefore easily be made at the factory to accommodate unusual edge conditions.

Figure 31:
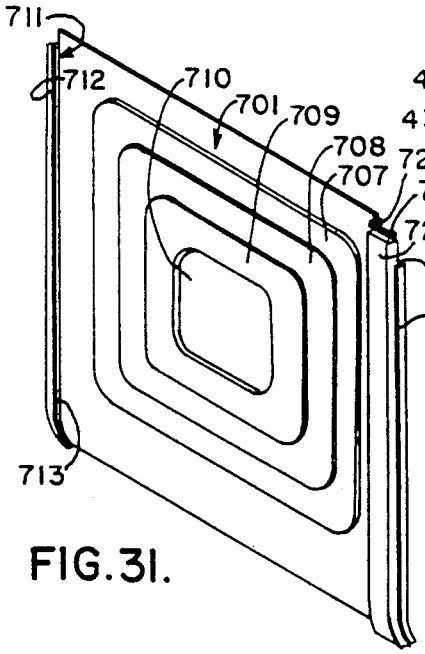
FIG. 31 is a view in perspective of a cladding shingle for use over an arch module of the structure of FIGS. 1 and 2.
Figure 32:
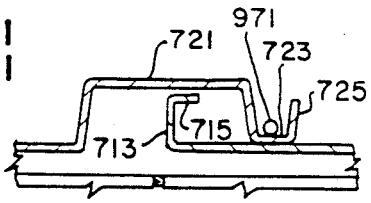
FIG. 32 is a sectional view taken along the line 32—32 of FIG. 2, showing the overlap of two shingles of FIG. 31.
Figure 33:
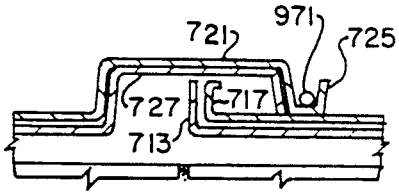
FIG. 33 is a sectional view taken along the line 33—33 of FIG. 2, showing the overlap of four shingles of FIG. 31.
Figure 35:
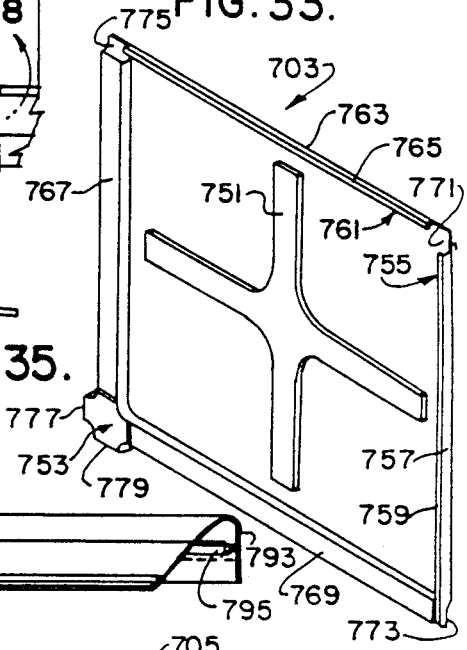
FIG. 35 is a view in perspective of a cladding shingle for use over a vertical portion of the structure of FIGS. 1 and 2.

The arch shingles 701 are shown particularly in FIGS. 31–33 and correspond one-to-one with the arch modules 501. The standard shingle 701 is 47.25" wide and 48.5" tall. It includes a generally planar upper portion, and the lower 2.75" of the shingle 701 is bent inwardly to an angle of 154.286° to match the angle between adjacent modules 501 in an arch of the structure 1. The lowermost 0.5" of the shingle 701 is bent inwardly to set off the shingle 701 slightly from the shingle 701 below it. The generally planar portion includes a set of three concentric 3.625" rings 707, 708, and 709, each raised 0.25" above the height of the area outside it, and a 13.5" central area 710 depressed 0.75" from the innermost ring 707.

At its left side, the shingle 701 includes a gutter portion 711 consisting of an upstanding wall 713 and an overturned lip 715. About 3.25" from the bottom of shingle 701, the upstanding wall 713 jogs inwardly about 0.25", and the outer portion of the overturned lip 715 is cut away accordingly, as indicated at 717. The overturned lip 715 terminates 3.25" from the top of the shingle 701, and the upstanding wall 713 extends to within 0.5" of the top of the shingle 701. As shown in FIG. 33, this arrangement allows the gutter portion 711 of an upper shingle 701 to fit over a lower shingle 701, with its wall 713 within the wall 713 of the lower shingle.

At its right side, the shingle 701 includes a 2.875" (inside) wide cap portion 721 designed to fit over the gutter portion 711 of a shingle 701 in an adjacent arch and a tie-down channel 723 outside the cap 721. The cap portion is 3.125" wide on its outside. The tie-down channel is defined in part by an upturned edge 725 spaced 0.5" from the outer edge of the cap 721. The lower 5.0" of the cap 721 flares to an inside width of 3.25". At its upper end 727, the cap 721 is necked down to a width of 2.686", and the cap 721 terminates 0.5" from the upper edge of the shingle 701. The channel 723 and upturned edge 725 terminate 2.5" from the top of the shingle 701. As shown in FIG. 33, the upper end 727 of the cap 721 thus fits under the cap 721 of a shingle 701 above it in an arch section and covers the gutter sections 711 of both adjacent shingles 701 in an adjacent arch section.

On the interior face of the shingle 701, a first set of three mounting hooks 729 is positioned on the upper edge of the shingle 701 for engagement of the free leg 465 of the cove rail 455, between the bent portions 466. The offset 731 of each hook 729 is spaced 1.0" below the upper edge of the shingle 701, so that the upper edge of the shingle 701 is spaced about 0.5" below the top of the module 501 when the shingle 701 is attached to the cove rail 455. A second set of three mounting hooks 733 is mounted along a horizontal line spaced from the upper hooks 729 a distance sufficient for their offsets 735 to engage the upper edge of the shingle 701 below it, approximately 45.0" below the upper hooks 729.

Figure 40:
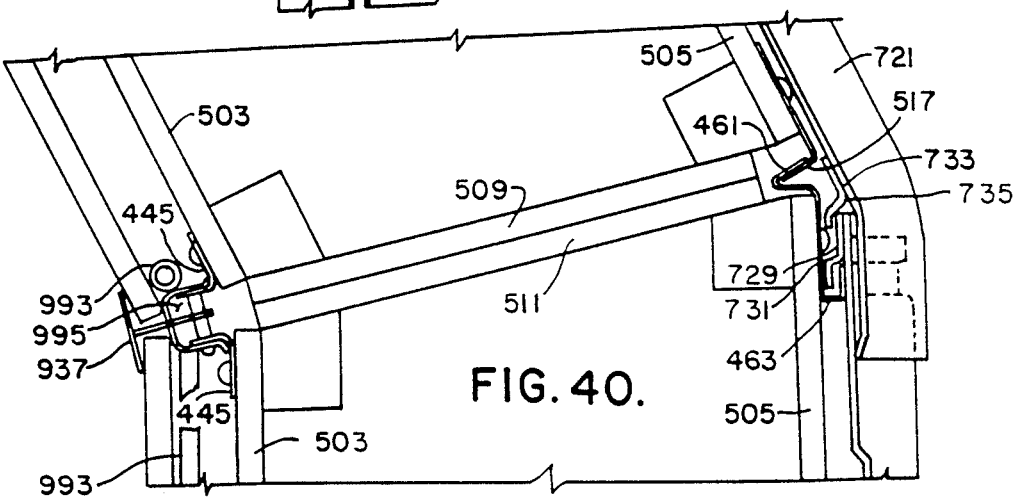
FIG. 40 is an assembly detail of the connection of two arch modules, and the associated exterior and interior details, in the area indicated by the line 40—40 of FIG. 2.

As shown in FIG. 40, the shingles 701 are hooked at their lower and upper ends and interlock to form a continuously overlapped protective skin over the arch modules 701. The shingles also provide a continuous cap 721 over a continuous gutter 711, including a continuous overturned lip 715, between arches of the structure. The joints between shingles 701 permit substantial thermal expansion and contraction in both vertical and horizontal directions without causing water leaks and without causing the shingles to become unhooked.

Figure 34:
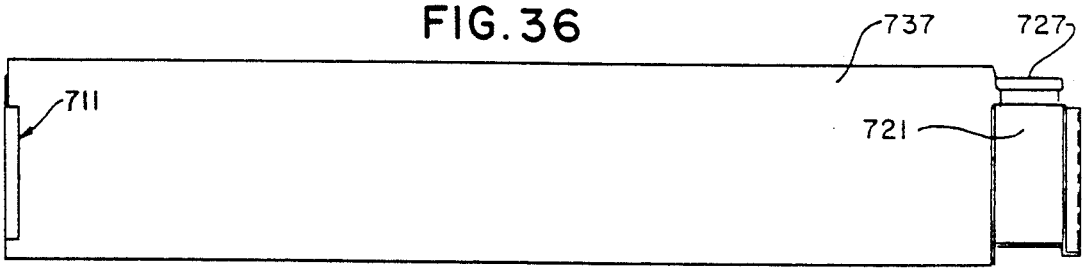
FIG. 34 is a view in front elevation of a prow shingle for use over a side of a floor module of FIGS. 6 and 7.
Figure 39:
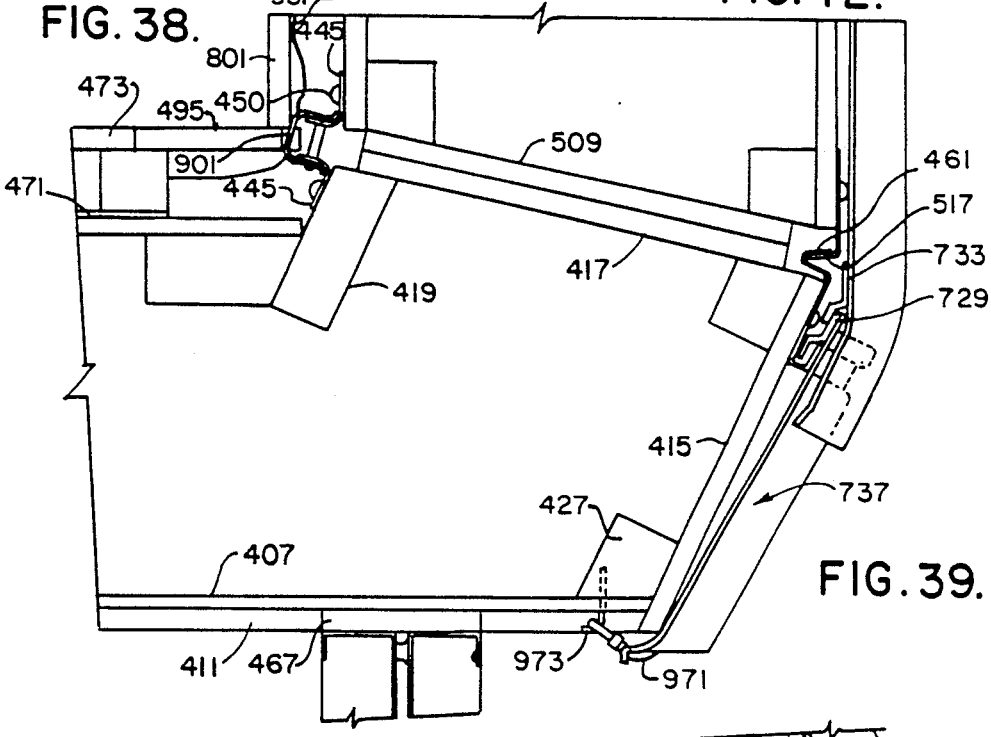
FIG. 39 is an assembly detail of the connection of an arch module to a floor module, and the associated exterior and interior details, in the area indicated by the line 39—39 of FIG. 2.

At the lower end of each arch, a special prow shingle 737 is provided, as shown particularly in FIGS. 34 and 39. It is 9.25" tall and it lacks the lower hooks 733 of the shingle 701, but it is otherwise substantially identical with the arch shingle 701.

At the left end of a half vault, the gutter section 711 is cut off, and a cap section 745, which is a mirror image of the cap section 721, is welded to the left side of the four arch shingles 701 and the prow shingle 737. In a full vault, eight arch shingles 701 will be thus modified, four at each end of the vault. The cap sections 745 and 721 at the ends of the vault overlap and engage the end shingles 703, as described hereinafter.

Figure 42:
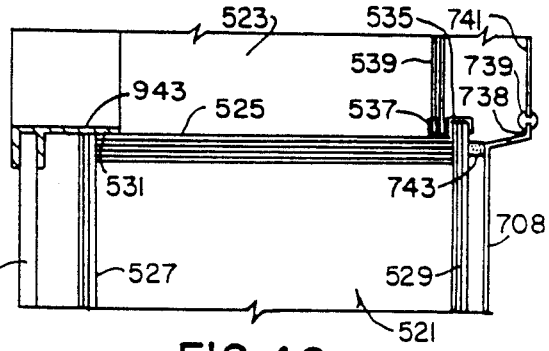
FIG. 42 is an assembly detail of a window area as indicated by the line 42—42 of FIG. 2.

For use over a window module 521, the arch shingle 701 is cut to provide a central opening, as shown in FIG. 42. A raised insert 738 is welded into the central opening to provide a window opening. Raising the window opening is particularly useful when utility lines are brought through the window opening to a junction box on the outside of the window module 521. When a window is provided in the window module 521, a rubber glazing frame 739 around the periphery of the shingle's window opening supports a transparent window 741 in the shingle 701. A foam gasket 743 adhered to the shingle 701 around the periphery of the window 741 reduces convection between the shingle 701 and the arch.

The vertical shingles 703 are shown particularly in FIGS. 34, 43–46, and 48–50. The standard shingle 703 is generally planar, with a raised stiffening cross 751 in its center. The standard shingle 703 is 46.75" wide and 47.25" tall, exclusive of a cruciform cover plate 753 integrally formed in its lower left corner.

Along its right side, the shingle 703 includes a gutter portion 755 consisting of an upstanding wall 757 and an overturned lip 759. The gutter portion 755 terminates about 2.5" from the top of shingle 703. The top edge of the shingle 703 includes a gutter portion 761 which similarly includes an upstanding wall 763 and an overturned lip 765. The gutter portion 761 terminates about 3.0" from the right and left margins of the shingle 703. Along the left side of the shingle 703, is a 2.5" (inside) wide cap portion 767 designed to fit over the gutter portion 755 of an adjacent shingle 703. The cap 767 terminates in a wall about 2.5" below the top of shingle 703. A 2.5" (inside) wide cap portion 769, designed to fit over the gutter portion 761 of a shingle 703 below it, extends along the lower edge of the shingle 703. The cap portion 769 terminates in a wall about 2.5" from the right margin of the shingle 703.

The upper right corner 771 of the shingle 703 is in the plane of the shingle. The lower right corner 773 of the shingle 703 is raised 0.375" from the plane of the shingle 703, although the overturned lip 759 continues in the same plane. The upper left corner 775 of the shingle 703 is raised 0.125" from the plane of the shingle 703.

The cruciform cover plate 753 is raised 0.125" above the cap portions 767 and 769, to cover and engage them where four shingles 703 meet. The plate 753 includes 0.75" extensions 777 and 779 to the left of and below the shingle 703. The cover plate 753 thus completely covers the overlap of four vertical shingles 703. It will be seen that the shingles 703 provide continuous vertical and horizontal gutters 755 and 761, covered by a continuous cap, which prevent infiltration even by blown rain.

Figure 55:
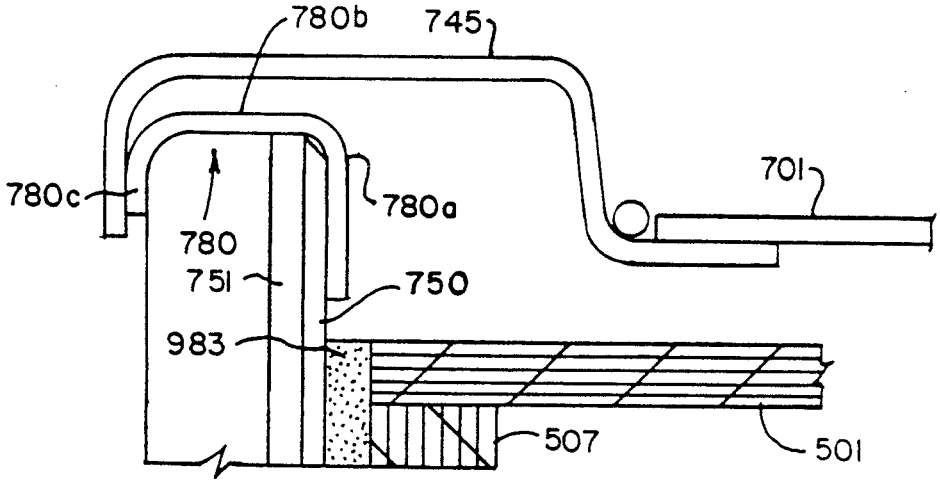
FIG. 55 is sectional assembly detail plan view of a connection between a cladding shingle over an end closure and a cladding shingle over an arch.

As shown in FIG. 2, each half arch end closure is covered with vertical shingles 703. Only one of the shingles 703, however, is "standard". The lower two full shingles 703 are modified by removal of the lower cruciform cap extensions 779. The other shingles 703 are modified by cutting away a portion of the shingle to conform to the end profile of the half arch. As shown in FIG. 55, at the cut edge, one leg 780*a* of a U-shaped gutter piece 780 is welded to the rear surface of the shingle 703, with the bottom 780*b* of the U forming an upstanding wall abutting the cut edge and the other leg of the U forming an overturned lip 780*c*. The cut edges of the shingles 703 extend beyond the outer walls 505 of the arch modules 501 by a distance sufficient to bring the bottom wall 780*b* of the gutter piece within about 0.25" of the inside wall of the cap 745 or the cap 721. As will become apparent hereinafter, a resilient foam gasket between the vertical shingles 703 and the ends 507 of the arch urges lip 780*c* of the gutter piece into engagement with the free end of the cap 721 or the cap 745 of the arch shingles 701, to prevent leakage of rain.

On the interior face of each shingle 703, Z-hooks 781 are welded at positions corresponding to the positions of the J-strips 621. The Z-hooks 781 have a length equal to the length of the corresponding J-strips 621, 621*a* and 621*b*. As shown, for example, in FIG. 45, Z-hooks 781 are also welded to the interior face of the vertical shingles 703 at positions to engage the upper ends of Z-hooks 781 on shingles 703 which they overlap.

The vertical walls of half vault sections are also covered by vertical shingles 703. Three shingles 703 are required for each half arch section. The connection of the vertical shingles 703 is shown particularly in FIGS. 43–45, and is similar to the connection of the shingles 703 to the end closure modules. An L-hook 783 at the upper end of the top shingle 703 engages the upper leg 459 of the cove rail 455 on the upper arch module 501, thereby preventing the top shingle 703 from lifting. The top shingle 703 is also supported by a ridge shingle as described hereinafter.

As shown in FIG. 48, where the vertical wall of a half vault meets the end closure of the half vault to form an outside corner, an L-shaped extension is 784 welded onto the cap part 769 of one of the vertical shingles 703, to complete the coverage of the gutter section 755 of the other.

As shown in FIG. 49, where the vertical wall of a half vault meets the end closure of the half vault to form an inside corner, the cap part 769 of one of the vertical shingles 703 is partially cut off to cover the gutter section 755 of the other.

As shown in FIG. 50, where the vertical wall of a half vault meets the end of a full vault, to "turn the corner", the arch shingle 701 is terminated in a gutter section 711, by replacing the cap section 721 where necessary. The vertical shingles 703 on the half vault wall are cut to fit the arch, and a cap/tie-down strip 785 is welded to the interior face of the shingle 703, with an upstanding wall 787 abutting the cut edge, with a cap portion 789 sized to extend over the gutter section 711 of the arch shingle 701, and with a tie-down channel 790 positioned immediately above the arch shingle 701.

Figure 36:
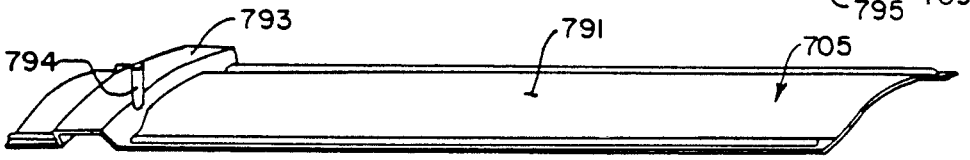
FIG. 36 is a view in perspective of a ridge cap cladding shingle for use over a full arch section of the structure of FIGS. 1 and 2.
Figure 41:
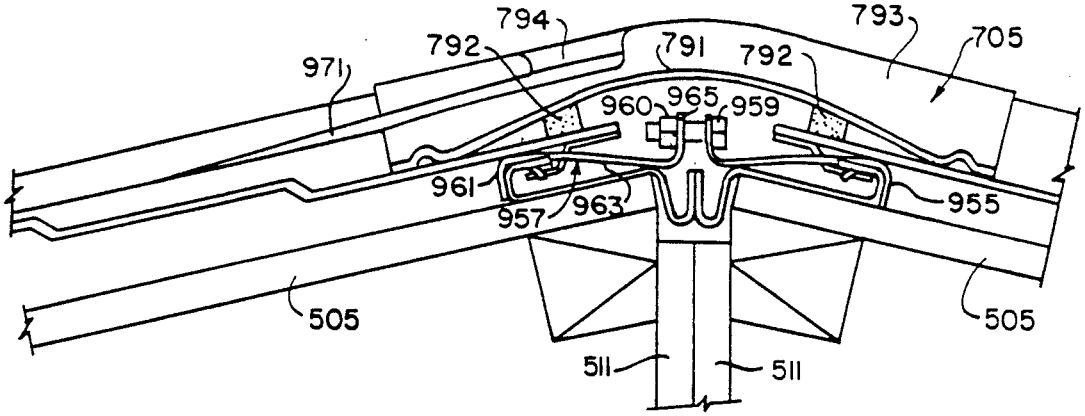
FIG. 41 is an assembly detail of the connection of two arch modules at the ridge of the structure, and the associated exterior and interior details, in the area indicated by the line 41—41 of FIG. 29.

The full ridge shingle 705 is shown particularly in FIGS. 36 and 41. It is 48.5" long and 8.5" wide. It is shaped to cover the top of a full vault section of the structure 1. The ridge shingle 705 includes a body part 791 having strip gaskets 792 adhered to its lower face for engaging the upper portions of arch shingles 701. The strips 792 provide insurance against leakage of blown rain into the top of the structure 1. Spaced 3.5" from its right end, the ridge shingle 705 includes a cap portion 793 sized to cover the cap portions 721 of the top arch shingles 701. A tie-down groove 794 is formed at a 45° angle across the cap portion 793. At the ends of a full vault section of the structure 1, the ridge cap is modified to correspond to the underlying arch shingles 701.

Figure 37:
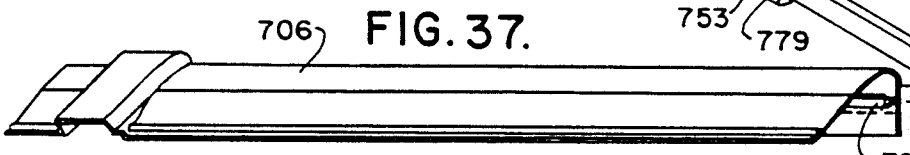
FIG. 37 is a view in perspective of a ridge cap cladding shingle for use over a half arch section of the structure of FIGS. 1 and 2.
Figure 43:
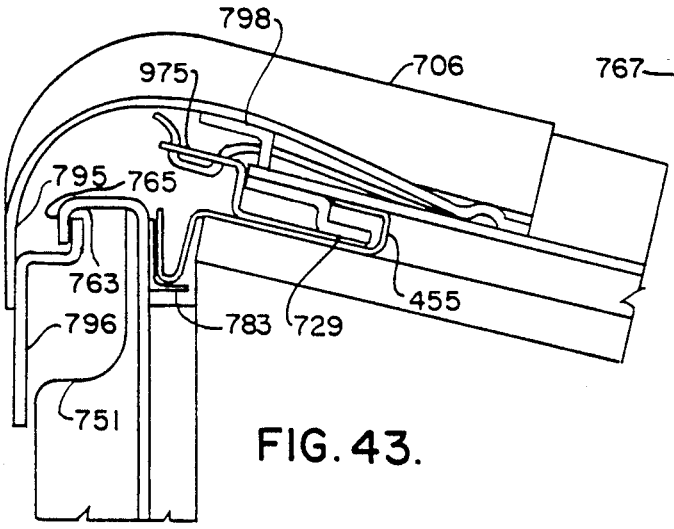
FIG. 43 is an assembly detail of the connection of cladding shingles over the ridge of a half-arch section of the structure, in the area indicated by the line 43—43 of FIG. 2.

The half ridge shingle 706 is shown particularly in FIGS. 37 and 43. It is 48.5" long and 6.375" wide. Its right side is shaped like the full ridge shingle 705. Its left side curves downwardly to a vertical wall 795, and a Z-hook 796 is welded across the lower end of the wall 795. The Z-hook 796 is sized to engage the upper wall 763 and the lip 765 of the top vertical shingle 705 of the vertical half arch wall. A cap portion 797 of the ridge shingle 706 is sized to cover the cap parts of both an arch shingle 701 and a vertical shingle 703. Within the ridge shingle 706, an L-shaped stand-off 798 provides a positive support for the ridge shingle 706 on the upper end of the top arch shingle 701.

It will be understood that a number of "hybrid" ridge caps will be used in special situations, such as at the ends of vault sections and at the intersections of half and full vault sections, either axially or orthogonally, of the structure 1.

The modular inner finish panels 8 are preferably plywood rectangles 801, sized to form a one-to-one correspondence with the arch modules 501 and spaced about 1.188" inward from the inner walls 503. The rectangles 801 are finished in any desired manner, including paint, wall covering, carpeting, sound absorbing material, or the like. Individual panels 8 may carry surface mounted or recessed lighting fixtures, electical or electronic control panels, electrical outlets, plumbing connections, appliances, furniture, or the like. In certain areas, such as ends of a vault and the area in which a corner is turned, panels of different sizes and shapes are required. The panels 8 are supported by special hardware described hereinafter.

The loose hardware used for assembling the structure 1 is quite limited. The primary connector for the body of the structure is a clip 901, shown particularly in FIG. 51. The clip 901 is a 8.0" long channel formed of twelve gauge high strength galvanized steel and having two legs 903 and 905 and a web portion 907. The legs 903 and 905 are spaced apart 1.0". One of the legs 903 is 0.75" longer than the other leg 905, and its extension 909 carries a pin 911 welded to it, 0.25" from the end of the leg 903. The pin 911 is 0.25" in diameter and 1.125" long. It extends perpendicular to the leg 903 across the channel. The free ends of the legs 903 and 905 flare outwardly, to permit the channel 901 to be fitted easily over a pair of flanges to be clamped by the clip 901.

Holes 915 are formed in both legs 903 and 905, spaced 0.25" from the end of the clip 901 opposite the pin 911. Holes 917 are formed in both legs 903 and 905, centered between the pin 911 and the holes 915. The central holes 917 are proportioned to engage the detents 443 on the module connectors 431 and the detents 453 on the arch connector rails 445, when the pin is placed through the holes 439 and 451 respectively. A hole 919 is provided in the web 907, spaced unequally from the ends of the clip 901, for purposes described hereinafter.

In use, the clip 901 is held perpendicular to the flanges to be clamped together, the pin 911 is placed through openings in the flanges to align the flanges along their lengths, and the clip is rotated around the pin 911 to clamp the flanges. Detents in the flanges engage the holes 917 to prevent the clips from rotating open. If desired, a lock pin or bolt may be pushed through the holes 915 and corresponding holes in the flanges to lock the clip against rotating open.

The clip 901 is so proportioned that when it is attached across a pair of module connectors 431, the top of the clip 901 is spaced 1.188" from the tops of the modules.

The clip 901 is used in the interior of the structure for connecting the floor modules 401 to each other and to the arch modules 501. It is also used in the interior of the structure for connecting the arch modules 501 to each other to form arches and for connecting arches to each other to form vaults. It is also used both in the interior and the exterior of the structure to connect vertical modules to each other to form end closures for full and half vaults, to form vertical half arch walls, and to connect end closures to half arch walls. It is also used for connecting full arch modules to half arch wall modules in turning corners.

For connecting end closures to floor modules and to arch modules, however, a modified form of the clip 901 is required. The modified clip 921 is shown particularly in FIGS. 52 and 46. A bracket 923, formed of twelve gauge high strength galvanized steel, is pivotally mounted on the clip 901 by a bolt 925 extending through the hole 919. The bracket 923 is 11.25" long and 1.25" wide and has 1.625" tall ears 927 at each end. A set screw 929 is threaded through one of the ears 927.

Figure 46:
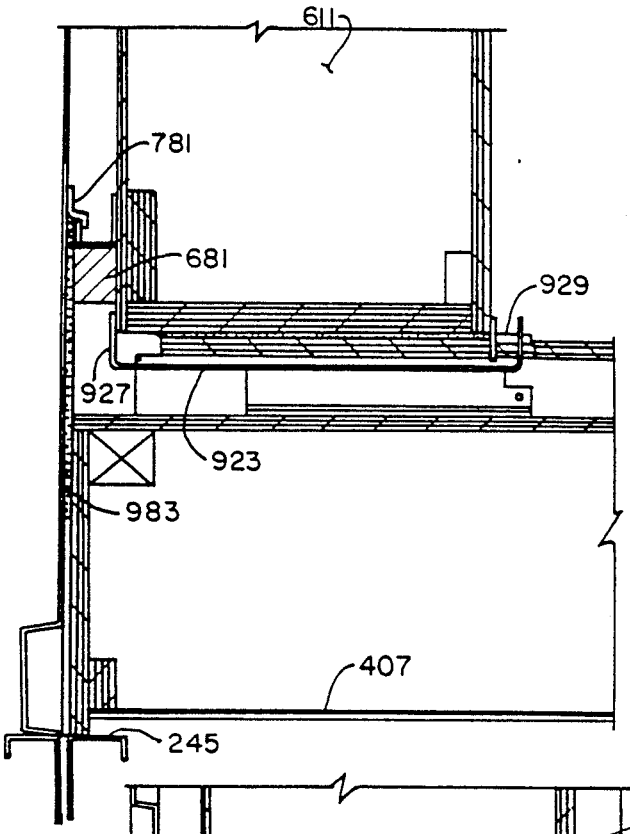
FIG. 46 is a sectional assembly detail in elevation of the connection of a vertical module over a floor module of the structure.

The modified clip 921 is positioned with the set screw 929 on the inside of the end closure, and the clip 911 is turned to match the holes in the module connectors 431 or the arch rails 445. As shown in FIG. 46, the pin of the modified clip 921 is to the inside of the floor modules 401. It is to the outside on the arch modules 501. It will be seen that the bracket 923 forms a small thermal bridge across the end closure panels. The effect of this bridge, however, is minimized both by the small mass of the bracket 923 and by gasketing covering the gap around the periphery of the end closures, as described hereinafter.

A finish panel trim strip 931, shown in FIG. 53, is in the form of a T-bar having cutouts 933 and slots 934 in its leg 935. The cutouts 933 allow the leg 935 to be inserted over clips 901 and shifted lengthwise to lock the trim strip onto the clips 901, with its head 937 spaced from the clips 901 sufficiently to trap finish panels 801 between the head 937 and the clip 901. The trim strips 931 are formed 1.0" shorter than sides of the panels 801. By inserting a trim strip 931 over a row of clips 901, shifting it to lock it in place, then inserting a 1.125" square stop piece 938 (FIG. 2) to prevent it from shifting back to its loose position, the strip 931 may be locked securely in place.

Extrusions 939 (FIG. 48) provide an edge for inside corners of finish panels 801. Extrusions 941 (FIGS. 49 and 50) provide an edge for outside corners of finish panels 801. Extrusions 943 (FIG. 42) are screwed to the window frame 523 and 525 to finish the window and provide an edge for panels 801.

The floor modules 403 are held to the joists 203 by floor straps 945, as shown in FIG. 54. The floor straps 945 include a T-bar 946 having a head part 947 and a leg part 948. A 1.0" wide nylon strap 949 is secured to the T-bar 946 through a slot 950 in its leg 948. The nylon strap is also secured to a plate 951 through a similar slot 952 in the plate. A hole 953 in the upper end of the plate 951 holds the plate to a pin 911 of a clip 901. The T-bar 946 and the plate 951 are formed of twelve gauge high strength galvanized steel.

The head 947 of the T-bar 946 engages the lower flanges 253 of the joists 203, and its leg 948 extends through the gap 249 between webs 251 of the joists 203. The nylon strap also extends through the gap 249 and along gasketing between floor modules 403. The nylon strap 949 is over 6.0" long, thereby preventing a thermal bridge between the joists 203 and the interior of the structure. The plate 951 is held to a clip pin 911 extending through a hole 439 of a module connector 431 attached to the floor module 403. The nylon strap is sized to hold the floor module firmly to the joist 203.

At the ridge of the structure 1, where the top modules of two half arches meet to form a full arch, a separate ridge connector 955 is provided for connecting the facing cove rails 455, as shown in FIG. 41. The connector 955 consists of two identical Z-clips 957 held together by a pair of bolts 959 and nuts 960. The Z-clips are 2.5" wide. Each Z-clip 957 includes an outboard vertical leg 961 for engaging the lower leg 463 of the the cove rail 455, a horizontal leg 963, and an inboard vertical leg 965, which includes a pair of holes for the bolts 959. The horizontal leg 963 is shaped to fit into the cut section 466 of the free leg 465 of the cove rail 455, to assure that the ridge connectors 955 are spaced properly. The ridge connector 955 is shipped bolted together with the nuts loosened on the bolts.

The arch shingles 701 are held down by cables 971. The cables 973 are 0.125" vinyl coated steel cables. On a full arch section, the cable is held at its ends by a hook 973 screwed into a blocking strip 427 at the bottom of the floor module 403, as shown in FIG. 39. The cable 971 extends up the side of the prow shingle 737 and arch shingles 701 in the tie-down channel 723. At the ridge shingle, the cable 971 extends through the tie-down groove 794 to the other side of the cap 793, as shown in FIG. 41, and down the tie-down channel 723 of the arch shingles 701 and prow shingle 737 of the other half arch to another hook 973. At the end of a full vault, the cable 971 does not cross over, but merely rests against the added cap 745 on one half arch.

At the ridge of a half arch, the cable 971 is threaded through a hole in the stand-off 798 and through holes in one leg of a metal Z-clip 975. The other leg of the Z-clip 975 is trapped by the cove rail 455, the hook 729 on the upper arch shingle 701, and by the upper end of the arch shingle 701. The ridge cap 706 is held down by the cable passing through the stand-off 798.

Gasketing 981 is applied, during erection of the structure 1, between abutting vertical faces of the boxes comprising the floor 4, arch portions 5 and vertical walls 6. Gasketing 981 is also applied during erection of the structure 1 to the horizontal surfaces of the vertical walls 6. The gasketing 981 is a resilient, closed cell, low density polyethylene foam, in 0.25" thick sheets. It is pre-cut to fit the sides of the boxes and is stapled onto the boxes after they are positioned, but before their neighbor is positioned. Preferably, the foam is dovetailed a short distance beyond the edges where gasketing will abut edge-to-edge, to insure that no air leaks occur along those edges. The gasketing 981 is compressed to 0.125" by the clips 901. The gasketing 981 is also applied as a facing gasket 983 around the periphery of the end closure formed of vertical modules 611, 613 and 615, to close the gap between the end closure and the arch modules 501 and the gap where raceways 493 penetrate the end closure. The vertical end closure shingles 703 compress the facing gasket 983 as shown in FIGS. 46 and 55.

Figure 56:
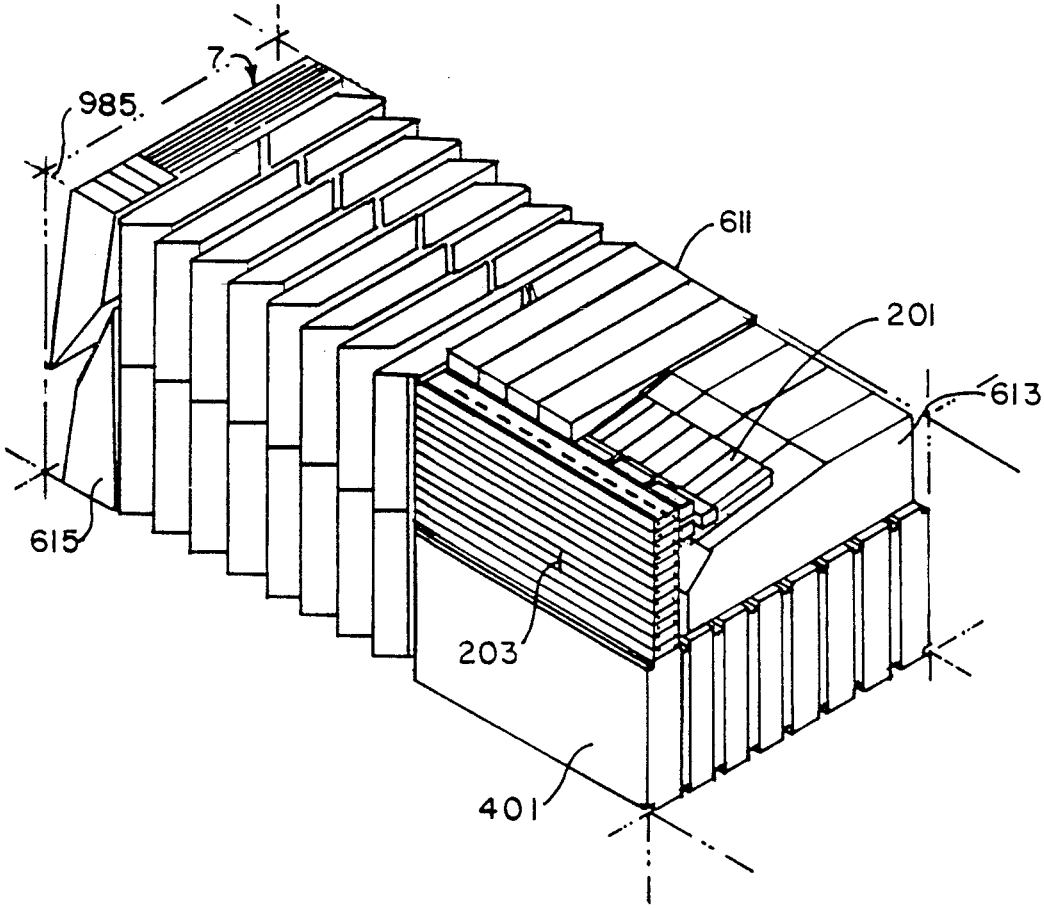
FIG. 56 is a somewhat diagramatic view in perspective of a four arch structure of the present invention, packed in a standard container.

The structure 1 is easily shipped in standard eight foot by eight foot by twenty foot ISO shipping containers. As shown in FIG. 56, an entire two hundred square foot building, including base frame 2, eight floor modules 401, thirty-two arch modules 501, two full end closure sets, and all necessary cladding shingles 7, may be packed in a single such container 985.

Because the parts of the structure 1 are of manageable size, and because no single element of the structure, even fully insulated, weighs more than two hundred pounds, the structure is easily removed from its shipping containers and assembled by two workers. The only tools required are wrenches, a screwdriver, a claw hammer, a stapler, and two small ladders or scaffolds. Assembly of the structure, even in complex shapes, does not require the use of any small, easily lost parts such as loose nuts and bolts. It may therefore be erected quickly in virtually any climate, even by workers wearing mittens. Once assembled, it provides an extremely sturdy and long-lasting structure, yet one which may be disassembled and reassembled on the same site or elsewhere, in the same or an entirely different configuration.

The frame 2 is assembled by laying out uprights 201 and joists 203 in their intended positions, adding one or two extension nodes 211 as necessary to accommodate the terrain, and roughly adjusting the height of the jacks 207 to level the framing nodes 209. If the foot pads 205 have been separated from the jacks 207, they are threaded onto the bolts 219. The joists are slipped onto the bolts 243 to form square frame sections arranged to accommodate the structure and deck desired. The frame is then squared by moving the frame to permit placing corner braces 263 in the holes 261. The joists 203 are then leveled by adjusting the jack screws 243, the foot pads are anchored by driving rods 213 through them into the ground, and bolts 243 are tightened to lock the joists 203 to the uprights 201. In areas requiring closer spacing of the joists, such as deck areas, intermediate joists 203 are added by slipping the keyholes 259 of the intermediate joist 203 over the bolts 273 and tightening the bolts 273 to attach joist hangers 267 to the ends of the intermediate joist 203, then angling the intermediate joist 203 into the opposed parallel channels 245 to seat the lower edges of the hanger plates 269 on the upturned lips 255 of the lower flanges 255, and then tightening the set screws 275 to lock the intermediate joist 203 to the parallel joists 203.

The base frame 2 provides an easily installed and leveled base for the structure 1. It is easily rearranged to provide different arrangements of the structure 1 and of the deck 281. It greatly reduces the impact of the structure 1 on the environment, and permits the structure 1 to be erected without substantial site preparation and to be removed without substantial injury to the land.

The deck 3 may be assembled to the frame either before or after the body of the structure 1 is assembled. In many instances, it is easier to install the deck modules 301 and the steps 305 first, to provide a platform for working on the body of the structure 1.

The body of the structure 1 is formed from the modular floor 4, arch portion 5, and vertical walls 6 as follows.

After the base frame 2 is formed as previously described, floor module boxes 403 are lifted onto it. The first module box 403 is placed at a corner of the frame 2 with its center end wall 413 and one side wall 411 extending along and resting on an upper flange 245 of the frame joists 203. One bearing channel 467 rests on the top of a corner upright connector 209 and the other bearing channel 467 rests across a joist 203 as shown in FIG. 39. A clip 901 is inserted into each of the two module connectors 431 at the center end wall 413, rotated upward as shown in FIG. 54. A floor strap 945 is fed through the joist 203 and hooked onto the pin 911 of each clip 901. Pre-cut gasketing 981 is stapled, with a few staples, to the end wall 413, to hold the gasketing temporarily. The second floor module box 403 is then positioned with its end wall 413 against the end wall 413 of the first module box 403 and pushed into position. The pins 911 of the clips 901 are then pushed through the corresponding holes 439 of the module connectors 431, and the clips 901 are pushed down over the module connectors 431 of the second floor module, thereby locking the two modules end-to-end. Frequently, the clips 901 must be hammered down tight over the detents 443. The z-clips 483 are then moved outward, floor pallets 405 are positioned on the floor modules 403, the z-clips 483 are moved in to hold the pallets 405, and the bolts 482 are tightened. The floor for a full arch section of the structure has now been completed.

It is usually convenient to continue adding floor modules in the same manner until the entire floor has been laid out and assembled, although it is possible to proceed immediately to building the first arch. After the floor modules 401 have been completely assembled, it is convenient to place all of the raceway covers 491 over the grid of raceways 493 formed, to provide a smooth floor for further work.

The arches 5 are then assembled. An arch module 501 is positioned on an end floor module 401, the arch module is tilted outward slightly, and the hook 517 on the arch module 501 is engaged with the free arm 461 of the cove rail 455 on the floor module 401. The arch module is then pulled inward, to tension the outer wall 505 of the arch module and the prow wall 415 of the floor module, the pin 911 of a clip 901 is pushed through the aligned holes 451 of the arch connector rails 445 on the arch module and the floor module, and the clip 901 is rotated over the free legs 449 of the arch connector rails 445. The other two clips 901 are then installed through and over the arch connector rails 445 in the same manner. This mounting method places both the outer wall 505 and the inner wall 503 of the arch module 501 in tension, thereby greatly strengthening the structure against forces exerted in either direction of strain on the arch.

After the first arch module has been secured, the second arch module is attached to it in exactly the same manner. The third and fourth arch modules of the half arch are likewise secured in the same manner, to complete a cantilevered half arch. The upper two modules require a ladder or scaffolding for mounting them conveniently.

The second half arch, facing the first, is erected in the same manner. When the two half arches have been completed, the facing upper two arch modules 501 are pulled down, the ridge clips 955 are tightened over their cove rails 455 on the outside of the arch 5, and the clips 901 are inserted through and over the arch connector rails 445 on the inside, to complete the arch 5.

Pre-cut gaskets 981 are tacked onto one side wall 507 of the eight modules 501 in the arch. Each gasket 981 is dovetailed to interlock with the gasket on the next module 501 and thus to provide continuous insulation.

The third cantilevered half arch is constructed adjacent the first. A lower module 501 is hooked to the cove rail 455 on the floor module box 403, and while it is tilted slightly outward it is pushed against the lower module 501 of the first half arch. It is then pulled inward, and its side module connectors 431 are clamped by clips 901 to the module connectors 431 on the adjacent module 501 of the first half arch. Its lower arch connector rail 445 is then clamped to the rail 445 of the floor module box 403. The rest of the third arch is built in the same manner, thereby forming a part of a vault section of the structure 1.

The fourth cantilevered half arch is built in the same way as the third, connected to the second half arch. It is then connected to third half arch to complete a two arch full vault.

Half arch sections of the structure are built in much the same way. A modified clip 921 is used for the connection of the floor modules 401 adjacent the edge 413. If a standard clip 901 has been used at the end position of either the floor or the arch, it is rotated up with the claw of a claw hammer, removed, and replaced with the modified clip 921. A cantilevered half arch is built. Then a 10.5" wide gasket 981 is stapled to the upper face of the pallet 403 spaced 11.688" from the center edge 413. The outer 0.562" of the gasket 981 drapes over the edge of the pallet 403. A narrow vertical module 655 is placed on the gasket 981, with a corner of the module 655 overlying the bracket 923 of the clip 921. The gasket 981 provides a slick surface for adjustment of the vertical module 655. When the module 655 is positioned, the set screw 929 is tightened to secure the lower margin of the module. Gasketing 981 is stapled to the upper face of the vertical module 655. Gasketing 981 is stapled to the upper face of a narrow upper vertical module 657, and it is placed on top of the vertical module 655. The upper module is shipped with the bolts 649 of its connectors 647 loose. Their pins 651 are aligned with the holes 451 of the arch connector rails 445 on the top arch module, and the bolts 649 are tightened to fix the pins 651 through the holes 451. As shown in FIG. 44, the tightened bolts 649 extend beyond the free ends 449 of the arch connector rails 445, thereby locking the rails 445 and clips 647.

Clips 901 are placed through and over the aligned module connectors 431 at the center of the interior and exterior abutting walls of the modules 655 and 657, to secure the modules to each other.

Additional half arch sections are built in the same manner, using the full vertical modules 611 and 645, to form a half vault section of the structure 1. Gaskets 981 are stapled to the vertical wall modules in the same manner as to the arch modules. Gaskets are applied to both sides of the narrow vertical modules 655 and 657. The vertical portions of the half arches are built adjacent the existing arch and held to it with clips 901. The vertical modules of the half vault are held to each other by clips 901 which join module connectors 431 on both the exterior and interior of the structure. The arches 5 are of course held to each other only on the interior of the structure.

The end closure of a full vault section is constructed by positioning the rectangular module 611 on a gasket 981, with the corner of the module 611 over the modified clip 921 at the end of the center raceway 493. A gasket 981 is stapled to both sides and the top of the module 611. The irregular side module 613 is placed next to the rectangular module 611 and clipped to it on the interior and exterior, with clips 901 placed through and over the module connectors 431. A gasket 981 is stapled to its upper surface. The irregular upper module 615 is positioned over the lower two modules and clipped to them. The entire assembly is then shifted into tight abutment with the brackets 923 of the modified clips 921 on the arch modules. The other half of the end closure is then built in the same way, clipped to the first half of the end closure. The entire assembly is then shifted to center it in the arch 5, so that both sides of the end closure are held by between the ears 927 of the brackets 923 of the modified clips 921. The set screws on the interior ends of the brackets 923 are then tightened with a screwdriver to hold the end closures.

The end closure of a half vault section is somewhat easier to construct, as indicated by FIG. 48. The irregular side module 613 is conveniently placed in position first, embraced by the brackets 923 on the arch module clips 921. A gasket 981 is stapled to the side of module 613, and the rectangular module 611 is placed against it and clipped to it. The module connectors 431 on the interior side of the rectangular module 611 are embraced by the connectors 647 on the outer side of the module 655 and are held by pins 651 when the bolts 649 of the connectors 647 are tightened. The irregular upper module 615 is positioned over the lower two modules and clipped to them and to the upper vertical module 657.

The facing gasket 983 is tacked with staples to the peripheral stapling strip 681 on the end closure and to the end walls of the arch panels 501 and the side walls of the floor modules 403. The facing gasket thus covers all the openings between the exterior of the body and the interior.

It will be seen that doors, windows, utility access ports, and other specialized vertical and arch modules may be substituted at will for the corresponding "standard" modules.

The construction of an axial intersection of full and half vault sections of the structure, as shown in FIG. 49, involves merely continuing one half vault, building a half end closure, and filling in the corner with the appropriate column module 659. Either the full vault section or the half vault section may be built before the other.

Construction of the orthogonal intersection of full and half vault sections of the structure, to turn the corner as shown in FIG. 50, involves merely substituting the special rectangular vertical module 661 and its mirror for standard modules 611 and substituting the special modules 663 and 665 and their mirrors for the upper modules 645. Either the full vault section or the half vault section may be built before the other, although it is probably easier to build the half vault section first, to gain easier access to the bolts 649. The connections of the special modules 663 and 665 to their adjacent vertical modules and to the upper end of the top arch module 501 is sufficient to make them self-sustaining during construction.

When the body of the entire structure 1 has been completed, the cladding shingles 7 are installed. The arch shingle are applied first, one arch at a time, beginning at the right side of each half vault as viewed from in front of that half vault. The arch shingles with the tie-down channel 713 removed are placed along the right-most arch. The prow shingle 737 is first hooked onto its cove rail 455. The bent-in sections 466 align the shingle with the arch. The next shingle 701 is then fitted over the prow shingle, then the upper three shingles are fitted in turn. A step ladder or a rope ladder hooked over the structure 1 is useful for fitting the upper shingles. The next arch is then shingled, with the cap portion 721 overlying the gutter portion 711 of the first arch's shingles 701. The left end half arch of the half vault is covered with the special shingle 701 having a second cap 745.

When all of the arch shingles have been put in place, all vertical shingles 703 are placed, starting from the left bottom corner of each vertical surface to be shingled. All of the bottom row of shingles are placed first, followed by all of the second row, then all of the top row.

As the shingles 703 are placed around the margin of the end closure, they are slipped under the cap 745 or 721 as shown in FIGS. 46 and 55, pushed against the facing gasket 983 to compress the gasket against the end closure modules and arch modules, and in turn are pushed outward by the facing gasket to mate with the cap 745 or 721. The upper shingles 703 over the end closure are held up only at their lower edges, with their upper ends being held only by the cap parts 745 or 721. The shingles are sufficiently stiff to resist sagging or buckling.

The special vertical shingles utilized in FIGS. 49 and 50 require no special application, except to install the overlying shingles last.

The shingles 703 automatically provide a continuous coverage to maintain a weathertight skin over the vertical surfaces, without the need for any tie-down.

The ridge cap shingles 705 and 706 are applied last. The full arch ridge caps are simply laid on top of the structure, overlaying succeeding shingles. They are held down initially by the friction of the gaskets 792. Cables 971 are then attached across the shingles from hook 973, over the ridge shingle 705, to second hook 973.

The cable 971 and Z-hook 796 are packaged with the half ridge cap 706, with the cable 971 extending outwardly through the stand-off 798. The half arch ridge cap 706 is tilted forward over the vertical wall to engage the gutter section 761 of the top shingle 703 and to permit the Z-hook 796 to be inserted under the hook 729 of the arch shingle 701. The cable 971 is then pulled down through the tie-down channel 723 of the arch shingles 701 to a hook 973 to hold the arch shingles 701 and the ridge cap 706.

The remaining gap around the end closure is now sealed, but it is not very effectively insulated. To maintain the ability to dismantle and re-erect the structure 1 with maximum ease, pre-cut insulation is inserted into the gap from the inside of the structure. If ease of dismantling is not a major concern, the gaps may be insulated in situ with a spray foam.

Before the finishing panels 801 are mounted, utility lines such as electric lines 991 and water lines 993 are run from an entry panel along a grid formed by the arch connector rails 445 and module connectors 431 on the arch modules and the grid formed by raceways 493 in the floor. The arch connector rails 445 and module connectors 431 include extra holes through which ties 995 hold the lines 991 and 993. The lines can thus be run securely from any point on the wall of the structure to any other point.

Figure 47:
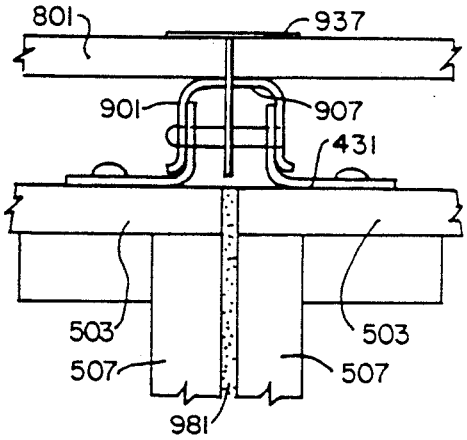
FIG. 47 is a sectional assembly detail in plan view of the connection of arch modules in adjacent arches, to form a vault portion of the structure.

When all utility lines have been run, the covers 491 are put back on the raceways and the covers 493 are put on. A desired floor treatment is applied, such as a continuous carpet or carpet tiles. The bottom finish panel 801 is mounted against the lowest clips 901 as shown in FIG. 39. Its upper end is held by the head 937 of a trim strip 931 as shown in FIG. 40, and its left side is held by vertical trim strip 931 as shown in FIG. 47. A square stop piece 939 is inserted between arch connector rails 445, to lock the trim strips 931. This process is continued until all of the finish panels have been mounted.

Numerous additional variations in the structure of the present invention, within the scope of the appended claims, will be apparent to those skilled in the art in light of the foregoing description and accompanying drawings.

Merely by way of example, other base supports including pontoons may be provided, or the structure may be built on a conventional foundation using only the margins of the floor modules to support the arch modules.

The size of each arch of the structure may be increased by the simple expedient of placing wedges between some or all of the arch modules. An upper floor could be added to the structure by suspension from the arch modules of such an expanded structure. Other shapes, such as domes, may be created by the addition of other modules for use with the arch modules or by modification of the arch modules, while using the same joinder hardware. Cylindrical structures may be formed entirely of arch modules and (modified) end closures.

A cantilevered half vault of the structure may abut an existing building, or the structure may be built on the flat roof of an existing building. A two story structure may be built by building four half-vault sections around an open square. Because the cantilevered half vault is self-sustaining, the axial wall may be partially or wholly omitted. A square frame around the upper edges of the four half vaults may not only provide support for the half vaults but may also act as a base frame 2 for an upper structure 1.

The engineered wood box structural modules are particularly desirable because they provide a modular framework without any separate supporting frame, they eliminate thermal bridges of less than R-10 at their perimeters, they create a cellular network of fire stops and vapor barriers throughout the structure, they permit openings to be formed at any part of the structure without loss of structural integrity, and they completely contain separate insulation material which may be chosen to fit the application. Nonetheless, the structural modules may be formed of other materials. For example, frameless honeycomb stress skin panels may be used. Conversely, arch panels which include skeleton frames with a flexible covering may be used in certain applications, such as greenhouses.

Some of the arch modules in one or more arch sections of the structure may be replaced with specialized modules. For example, the first (bottom or parapet) arch module and the second arch module may be replaced with dormer modules to form a vertical frame extending upwardly from the base of the arch to the top of the second module, about 76" above the floor 4. The dormer may hold a door to the structure. Two parallel full arch sections of the building structure may also be connected by mating dormer sections in corresponding arches.

The cladding shingles may be made of different materials as appropriate for different applications. For example, they may be made of material which absorbs electromagnetic energy of particular wave lengths to make the structure radio-opaque, or which shields from various forms of radiation, or which converts sunlight to heat or electricity, or which is highly abrasion resistant. Less desirably, the cladding may also be in the form of flexible sheet, or it may be omitted altogether by modification of the structural modules to make the structure water resistant. Because the cladding shingles are spaced from the structural modules and air paths are provided in the space under the shingles, a ventilated ridge cap may be used to increase ventilation in hot climates. The cladding may be configured to collect water or to support various auxiliary equipment.

The interior finish panels may be omitted, or other interior finishes, including standard plasterboard, may be utilized.

These variations are merely illustrative.

I claim:

1. A building structure comprising a plurality of voussoirs stacked to form at least a part of a barrel vault, each of said voussoirs comprising a rectangular outer wall and a rectangular inner wall, said inner wall being smaller in at least one dimension than said outer wall, each of said voussoirs including interconnecting means on at least two parallel horizontal sides of said outer wall for connecting said voussoir to other said voussoirs, and wherein said interconnecting means cause said outer wall to be tensioned when said voussoirs are stacked.

2. The building structure of claim 1 wherein said voussoirs have substantially the same dimensions, each of said outer walls having a height of from three to five feet, eight of said voussoirs being stacked to form an arch section of a full barrel vault, the lowermost voussoirs being vertical.

3. A building structure having walls and roof portions defining an enclosed volume, said walls and roof consisting essentially of a plurality of modules, each of said modules having a broad outer wall and a broad inner wall generally parallel to and spaced from said broad outer wall, and lip means, positioned around the periphery of said inner wall, for connecting said module to other said modules, most of said modules have a dimensions of from three feet to five feet wide by from three feet to nine feet tall by from three inches to eighteen inches deep and a volume of from three cubic feet to forty cubic feet, all of said modules having a weight of less than two hundred pounds, said modules being placed edge to edge so that said broad inner walls define an interior surface of said structure, and connector means accessible only from within said structure for connecting said lip means of adjacent modules to each other to provide a secure structure.

4. The structure of claim 3 wherein said lips form a lattice, and wherein said structure includes at least one elongate utility line extending across a plurality of said modules, said utility line being supported by said lip means.

5. The structure of claim 4 wherein said broad inner walls are rectangular and have four edges.

6. The structure of claim 3 wherein said modules form walls, roof and floor of said structure.

7. The structure of claim 3 further including finishing panels attached to said lip means, said finishing panels having dimensions substantially equal to the dimensions of said inner walls and being parallel to and spaced from said inner walls of said modules.

8. The structure of claim 3 wherein said connector means comprise generally U-shaped clips.

9. The structure of claim 8 wherein said lips include apertures, said apertures being aligned when said modules are assembled, and wherein said clips include pins extending through said apertures of said lips of adjacent modules, said clips being rotatable around said pins to compress said lips.

10. The structure of claim 3 wherein each of said modules includes interconnecting means on at least two parallel sides of said outer wall, for connecting said module to other said modules.

11. The structure of claim 10 wherein at least some of said modules are voussoirs, said inner wall of each voussoir being smaller in at least one dimension than said outer wall, wherein said voussoirs are stacked to form at least a part of an arch, and wherein said interconnecting means cause said outer wall of said voussoirs to be tensioned when said voussoirs are stacked.

12. The structure of claim 3 wherein at least some of said modules are voussoirs, said inner wall of each voussoir being smaller in at least one dimension than said outer wall, and wherein said voussoirs are stacked to form at least a part of an arch.

13. The structure of claim 3 wherein at least some of said modules are voussoirs, said voussoirs being identical in size and shape, each of said voussoirs having a width of from about three feet to about five feet, a height of from about three feet to about five feet, and a depth of from about six inches to about eighteen inches, said voussoirs forming at least two walls and a roof of said structure.

14. The structure of claim 13 wherein said inner wall of each voussoir is shorter than said outer wall, and wherein said voussoirs are stacked to form an arch.

15. A building structure comprising a plurality of identical modules, each of said modules being in the form of a six-sided hollow box filled with an insulating material to give an insulation value of at least R-35, said box comprising a rectangular outer wall, a rectangular inner wall, said inner wall being generally parallel to and spaced from said outer wall and being smaller in at least one dimension than said outer wall, a pair of trapezoidal side walls, and a pair of rectangular side walls, and means for releasably interconnecting said modules to form at least a major portion of said structure, said modules eliminating thermal bridges of less than R-10 at the perimeters of said modules in the completed building structure.

16. A building structure comprising a plurality of six-sided modules, each of said modules comprising a rectangular outer wall and a rectangular inner wall, said inner wall being generally parallel to and spaced from said outer wall and being shorter than said outer wall, and connecting means for connecting said modules to each other to form a structure having an outer wall and an inner wall, said connecting means comprising hook and cove means carried by said outer walls of said modules for connecting said modules to each other, and lip means carried by said inner walls of said module for connection to each other to draw said modules tightly together, said connector means and said modules being so shaped and proportioned as to cause both said outer wall and said inner wall of said structure to be tensioned when said modules are connected and drawn tightly together.

17. The building structure of claim 16 wherein said lip means comprise inwardly extending lips, said lips being spaced apart and being held by clips when said modules are assembled.

18. A building structure comprising at least one portion formed from arch elements forming a self-supporting full barrel vault having an axial length, a height, and a width, and at least a second portion formed from arch elements and vertical wall elements forming a half barrel vault having an axial length substantially greater than the width of said full barrel vault and a height equal to the height of said full barrel vault, said half barrel vault being perpendicular to said full barrel vault, an end of said full barrel vault mating with said vertical wall elements of said half barrel vault to form a continuous T-shaped interior of said building structure.

19. The structure of claim 18 wherein said arch elements are of a single size and shape, wherein four said arch elements are stacked to form an arch section of said half vault, and eight said arch elements are stacked to form an arch section of said full vault.

20. The structure of claim 19 wherein said structure is frameless and wherein said arch elements are voussoirs stacked to form half arches arranged side to side to form said half barrel vault, interconnecting means on the outside of said vault for releasably connecting voussoirs in each half arch to each other, and connecting means for releasably attaching said half arches to each other.

21. The building of claim 19 wherein said vertical wall includes means defining an arched opening mating with said end of said full barrel vault.

22. The building of claim 20 including a further plurality of voussoirs stacked to form said full barrel vault.

23. The building of claim 20 further including an end wall at least partially enclosed by one said half arch at each end of said half barrel vault.

24. The building of claim 20 wherein each said voussoir includes an outside skin, an inside skin, and an insulator of a different material from either said outside skin or said inside skin between said outside skin and said inside skin.

25. A building structure comprising a plurality of modules forming a major portion of said structure, each of said modules having an inside face and an outside face, each of said faces having a width of from about three feet to about five feet and a height of from about three feet to about five feet, and a plurality of finishing panels attached to said modules, said finishing panels having dimensions substantially equal to the dimensions of said inner faces and being parallel to and spaced from said inner faces of said modules, said finishing panels defining an inner wall of said structure.

26. A building structure comprising a plurality of modules forming a major portion of said structure, each of said modules having an inside face and an outside face, each of said faces having a width of from about three feet to about five feet and a height of from about three feet to about five feet, said modules being rigidly connected to each other, and a plurality of cladding shingles attached to said modules, said cladding shingles having dimensions slightly greater than the dimensions of said outer faces and being spaced from said outer faces of said modules in one-to-one relation to said modules, said cladding shingles overlapping each other to define a substantially continuous outer skin over at least a top and two sides of said structure.

27. The structure of claim 26 wherein said shingles are moveable with respect to each other to permit expansion and contraction of said shingles with changes in temperature, and wherein said shingles include rain gutter means along a vertical edge thereof and cap means on an opposite vertical edge thereof, said cap means of one said shingle overlapping said rain gutter means of an adjacent said shingle.

28. The structure of claim 26 wherein said structure is formed at least in part as a barrel vault, said modules being voussoirs.

29. The structure of claim 28 further including end modules forming ends of said barrel vault, each of said end modules having an inside face and an outside face spaced from said inside face, each of said faces having a width of from about three feet to about five feet, said end modules being rigidly connected to each other, and a plurality of cladding end shingles attached to said end modules, said cladding end shingles being spaced from said outer faces of said modules, said cladding shingles overlapping each other to define a substantially continuous skin over said ends of said barrel vault.

30. A module for construction of a modular building structure, said module being formed as a trapezoidal prism having an inner rectangular periphery and an outer rectangular periphery which is larger in at least one dimension than the inner periphery, means defining inwardly-extending lips at said inner periphery for connection of the module to other similar modules, means defining a hook at one edge of said outer periphery and means defining a sill at an opposite edge of said outer periphery, said sill being adapted to engage a hook on another similar module to interconnect the modules in edge-to-edge relation.

31. The module of claim 30 including an outer wall defining said outer periphery and an inner wall defining said inner periphery, an opening in said outer wall, an opening in said inner wall, and a window structure mounted between said openings, said window structure including peripheral wall means engaging edges of said openings.

32. A building structure comprising a frame support including a plurality of adjustable ground-engaging uprights, each said upright including adjustment means for adjusting the height of said upright and a fitting piece attached to an upper end of said upright, said fitting piece including at least two fittings, and a plurality of horizontal joists supported above ground by said uprights, each said joist including flange means at its ends for releasably connecting said joist to one of said fittings, said joists being arranged as a rectangle having uprights at least at the corners thereof, said rectangle including side joists defining a pair of sides, and a plurality of parallel cross joists attached to said side joists intermediate said uprights, said side joists being C-shaped in cross section, and said cross joists including end flanges, said structure further including attachment plates interfitted into said C-shaped side joists, said end flanges of said cross joists and said attachment plates being releasably connected, and a modular building supported by said joists.

33. A building structure comprising a frame support including a plurality of adjustable ground-engaging uprights, each said upright including adjustment means for adjusting the height of said upright and a fitting piece attached to an upper end of said upright, said fitting piece including at least two fittings, and a plurality of horizontal joists supported above ground by said uprights, each said joist including flange means at its ends for releasably connecting said joist to one of said fittings, each of said uprights including a vertical column, height adjusting means in said column, a foot pad, means for anchoring said foot pad to the earth, and pivot means for attaching said foot pad to said column, and further including an extension piece removably connected to an upper end of at least one said column for extending the height of said upright, and a modular building supported by said joists.

34. A building structure comprising a frame support including a plurality of adjustable ground-engaging uprights, each said upright including adjustment means for adjusting the height of said upright and a fitting piece attached to an upper end of said upright, said fitting piece including at least two fittings, and a plurality of horizontal joists supported above ground by said uprights, each said joist including flange means at its ends for releasably connecting said joist to one of said fittings, at least one of said fitting and said flange means including a slot and the other of said fitting and said flange means including a headed bolt for interengagement with said slot, said bolt being tightenable after engagement with said slot, and a modular building supported by said joists.

35. An arch structure comprising eight substantially identical arch modules, each of said arch modules being in the form of a regular trapezoidal prism having a height of from three feet to five feet, a width of from three feet to five feet and a thickness of from three inches to eighteen inches, said modules being releasably attached to each other to form eight sides of a regular tetradecagon having vertical lowermost modules, the interior height of the module above the lowermost module reaching at least about seventy-two inches, within a distance of eighteen inches inboard from the vertical lowermost module.

36. A building structure composed of a plurality of arch structures in accordance with claim 35, said arch structures being attached side to side to form a barrel vault.

37. A barrel vault structure comprising a plurality of modules releasably attached to each other to form a plurality of arches arranged side to side, each module including an outer wall and an inner wall spaced from said outer wall;

a plurality of finishing panels releasably attached to the inside of said barrel vault, at least most of said finishing panels having dimensions substantially equal to the dimensions of said inner walls of said modules and being parallel to and spaced from said inner walls of said modules in one-to-one relation to said modules, said finishing panels defining an inner wall of said structure, and a plurality of cladding shingles releasably attached to said modules, at least most of said cladding shingles having dimensions slightly greater than the dimensions of said outer walls and being spaced from said outer walls of said modules in one-to-one relation to said modules, said cladding shingles overlapping each other to define a substantially continuous outer skin over said barrel vault.

38. The structure of claim 37 comprising connecting means inside said barrel vault for connecting said modules to each other, and support means carried at least in part by said connecting means for supporting said finishing panels.

39. The structure of claim 37 further including lip means positioned around the peripheries of said modules, connector means accessible only from within said structure for connecting said lip means of adjacent modules to each other to provide a secure structure, and at least one utility line extending across a plurality of said modules, said utility line and said finishing panels both being supported at least in part by at least one of said lip means and said connector means, said finishing panels being individually removable to expose said utility line.

40. A floor for a building structure, said floor comprising a plurality of rectangular modules having four sides, said modules being arranged side to side, each of said modules comprising a horizontal wall defining a floor surface, said horizontal wall terminating at a distance from at least two perpendicular said sides to provide a grid of raceways between said modules, and cover means for covering said raceways and forming a substantially planar floor with said horizontal walls of said modules.

41. The floor of claim 40 wherein each of said modules includes upstanding lip means along said at least two perpendicular sides, said lip means extending upwardly to a height less than the height of said horizontal wall, said floor further including attachment means for attaching said lip means of adjacent modules to each other.

42. The floor of claim 41 wherein said lip means include openings therein, said openings being aligned when said lip means are attached to each other, and wherein said attachment means comprise a clip, said clip including a pin extending through said openings and a U-shaped yoke embracing said lip means, said yoke being rotatable around said pin when said pin extends through said openings.

43. A building structure comprising a floor and a plurality of voussoirs supported by said floor, said floor comprising a plurality of rectangular modules arranged side to side, each of said modules comprising a horizontal wall defining a floor surface and an outwardly downwardly sloping support wall at one margin thereof, said voussoirs being in the form of regular trapezoidal prisms, one non-parallel face of one said prism resting on said support wall of each said floor module in one-to-one relation, and at least two parallel faces of said one prism being vertical.

44. A modular building constructed of preinsulated modules, which may be erected by two workers without special lifting equipment, said modules being attached to each other to form floor, roof and walls of said building without framing supports between said modules, most of said modules having a volume of from about three cubic feet to about forty cubic feet, and all of said modules having a weight of less than about two hundred pounds.

45. The building of claim 44 wherein most of said modules have a dimensions of from three feet to five feet by from three feet to nine feet by from three inches to eighteen inches.

46. The building structure of claim 26 further including at least one window extending between the inside face and the outside face of the substructure, a single one of said cladding shingles including window means formed in said cladding shingle of substantially the same size as the window in the substructure and aligned therewith, said window means being sealed to said cladding shingle.

47. The structure of claim 26 further including a plurality of interior facing panels attached to said modules, said facing panels having dimensions substantially equal to the dimensions of said inner faces and being parallel to and spaced from said inner faces of said modules, said facing panels defining an inner wall of said structure.

* * * * *